US009284138B2

(12) United States Patent
Hino

(10) Patent No.: US 9,284,138 B2
(45) Date of Patent: Mar. 15, 2016

(54) SHEET FEEDING APPARATUS, IMAGE READING DEVICE AND IMAGE FORMING APPARATUS

(71) Applicant: CANON KABUSHIKI KAISHA, Tokyo (JP)

(72) Inventor: Takeshi Hino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/487,273

(22) Filed: Sep. 16, 2014

(65) Prior Publication Data

US 2015/0084264 A1 Mar. 26, 2015

(30) Foreign Application Priority Data

Sep. 20, 2013 (JP) ..... 2013-194824
Sep. 12, 2014 (JP) ..... 2014-186457

(51) Int. Cl.

| | |
|---|---|
| ***B65H 29/00*** | (2006.01) |
| ***B65H 3/06*** | (2006.01) |
| ***B65H 1/04*** | (2006.01) |
| ***B65H 85/00*** | (2006.01) |
| ***B65H 5/06*** | (2006.01) |
| ***B65H 9/00*** | (2006.01) |

(52) U.S. Cl.

CPC ..... *B65H 3/0669* (2013.01); *B65H 1/04* (2013.01); *B65H 3/0684* (2013.01); *B65H 5/062* (2013.01); *B65H 9/006* (2013.01); *B65H 85/00* (2013.01); *B65H 2301/33312* (2013.01); *B65H 2403/481* (2013.01); *B65H 2403/512* (2013.01); *B65H 2403/72* (2013.01); *B65H 2404/1441* (2013.01); *B65H 2405/3321* (2013.01); *B65H 2801/06* (2013.01); *B65H 2801/39* (2013.01)

(58) Field of Classification Search

CPC ..... B65H 15/02
USPC ..... 271/184, 185, 186, 224, 225, 65, 207
See application file for complete search history.

(56) References Cited

U.S. PATENT DOCUMENTS

| | | | | |
|---|---|---|---|---|
| 7,530,568 | B2 | 5/2009 | Uchida et al. | |
| 2005/0263956 | A1 | 12/2005 | Uchida et al. | |
| 2011/0115146 | A1* | 5/2011 | Shimomura et al. | 271/10.13 |

FOREIGN PATENT DOCUMENTS

| | | | |
|---|---|---|---|
| JP | 11-263472 | A | 9/1999 |
| JP | 2005-335915 | A | 12/2005 |

* cited by examiner

*Primary Examiner* — Thomas Morrison
(74) *Attorney, Agent, or Firm* — Fitzpatrick, Cella, Harper & Scinto

(57) ABSTRACT

The invention includes a swing mechanism contacting/separating a driven discharge roller with/from a driving discharge roller by swinging a support portion rotatably supporting the driven discharge roller. A planetary gear mechanism is provided in a power transmitting route from a driving source to the swing mechanism. The planetary gear mechanism switches the transmission of the driving force to the swing mechanism into a transmission state and a cutoff state by the switching portion.

18 Claims, 12 Drawing Sheets

SHEET FEEDING APPARATUS, IMAGE READING DEVICE AND IMAGE FORMING APPARATUS

BACKGROUND OF THE INVENTION

1. Field of the Invention

The present invention relates to a sheet feeding apparatus configured to feed a sheet (document), an image reading apparatus including the sheet feeding apparatus, and an image forming apparatus including the image reading apparatus.

2. Description of the Related Art

Hitherto, there is known an image reading apparatus including an automatic document feed apparatus (ADF) enabling to skim image information, i.e., to read the image information, of a document passing on a platen glass by an optical system disposed under the platen glass. There is also known a so-called reverse reading type image reading apparatus configured to switch-back and to reversely convey a document whose image of a first face has been read by a discharge roller pair to pass on the platen glass again and to read an image of a second face on a back of the first face.

Here, if a length of a sheet whose image is to be read exceeds a predetermined range in the case of the reverse reading type image reading apparatus, there is a case where a front end of the switch-backed document arrives at a discharge roller pair before a rear end of the document passes through a nip of the discharge roller pair, thus becoming incapable of conveying the document. Therefore, it is necessary to release the nip of the discharge roller pair at predetermined timing to pass through the document in reading both-side images of a document whose length exceeds a predetermined length.

As a method for releasing the nip of the discharge roller pair, Japanese Patent Application Laid-open No. H11-263472 discloses a technology of connecting a solenoid to a driven discharge roller driven by a driving discharge roller and releasing the nip of the discharge roller pair by separating the driven discharge roller from the driving discharge roller by the solenoid. However, a relatively large solenoid is required to separate the driven discharge roller from the driving discharge roller directly by the solenoid by resisting against a nip pressure of the discharge roller pair. Accordingly, this poses a problem that the large solenoid as described above is required in addition to such a motor that rotates the discharge roller pair and that the apparatus is thus enlarged.

Meanwhile, Japanese Patent Application Laid-open No. 2005-335915 discloses a technology including a cam mechanism enabling to contact/separate a driven discharge roller to/from a driving discharge roller and separating the driven discharge roller from the driving discharge roller by transmitting power from the motor not only to the driving discharge roller but also to the cam mechanism through a gear train.

Here, the cam mechanism disclosed in Japanese Patent Application Laid-open No. 2005-335915 is provided with an electromagnetic clutch between the gear train and the cam mechanism to transmit the power from one motor to both of the driving discharge roller and the cam mechanism. This technology makes it possible to contact/separate the driven discharge roller with/from the driving discharge roller at any timing without repeating the contact/separation of the rollers during when the driving discharge roller is driven by disconnecting/connecting the transmission of the power from the motor to the cam mechanism by the electromagnetic clutch.

However, the configuration using such an electromagnetic clutch has problems that a structure of the electromagnetic clutch itself is complicated and that a structure of an apparatus is complicated because the apparatus requires a gear train as a gearshift mechanism shifting rotations from the motor beside the electromagnetic clutch.

SUMMARY OF THE INVENTION

According to one aspect of the invention, a sheet feeding apparatus includes a conveying roller pair configured to convey a sheet, a discharge roller pair including a driving discharge roller configured to normally rotate and discharge the sheet out of the apparatus and to reversely rotate and convey the sheet that has once passed through the conveying roller pair again toward the conveying roller pair and a driven discharge roller configured to rotate by being driven by the driving discharge roller, a driving source, and a separating mechanism configured to contact the driven discharge roller with the driving discharge roller and separate the driven discharge roller from the driving discharge roller by switching input rotations generated by the driving source to normal and reverse rotations. The separating mechanism includes a support portion rotatably supporting the driven discharge roller, a swing mechanism configured to swing the support portion by receiving a driving force from the driving source and separate the driven discharge roller from the driving discharge roller, a planetary gear mechanism provided within a power transmission path from the driving source to the swing mechanism, and a switching portion switching the planetary gear mechanism to a transmission state in which a power of the driving source is transmitted from the driving source to the swing mechanism and to a cutoff state in which the transmission of the power from the driving source to the swing mechanism is cut off.

Further features of the present invention will become apparent from the following description of exemplary embodiments with reference to the attached drawings.

DESCRIPTION OF THE EMBODIMENTS

An image forming apparatus according to an embodiment of the present invention will be explained below with reference to the drawings. The image forming apparatus of the present embodiment includes an image reading apparatus having a sheet feeding apparatus capable of automatically feed a sheet such as a copier, a printer, a facsimile, and a multi-function printer. The image forming apparatus will be exemplified by an electro-photographic laser beam printer (referred to simply as a 'printer' hereinafter) 100 in the following embodiment.

First Embodiment

Figure 1:
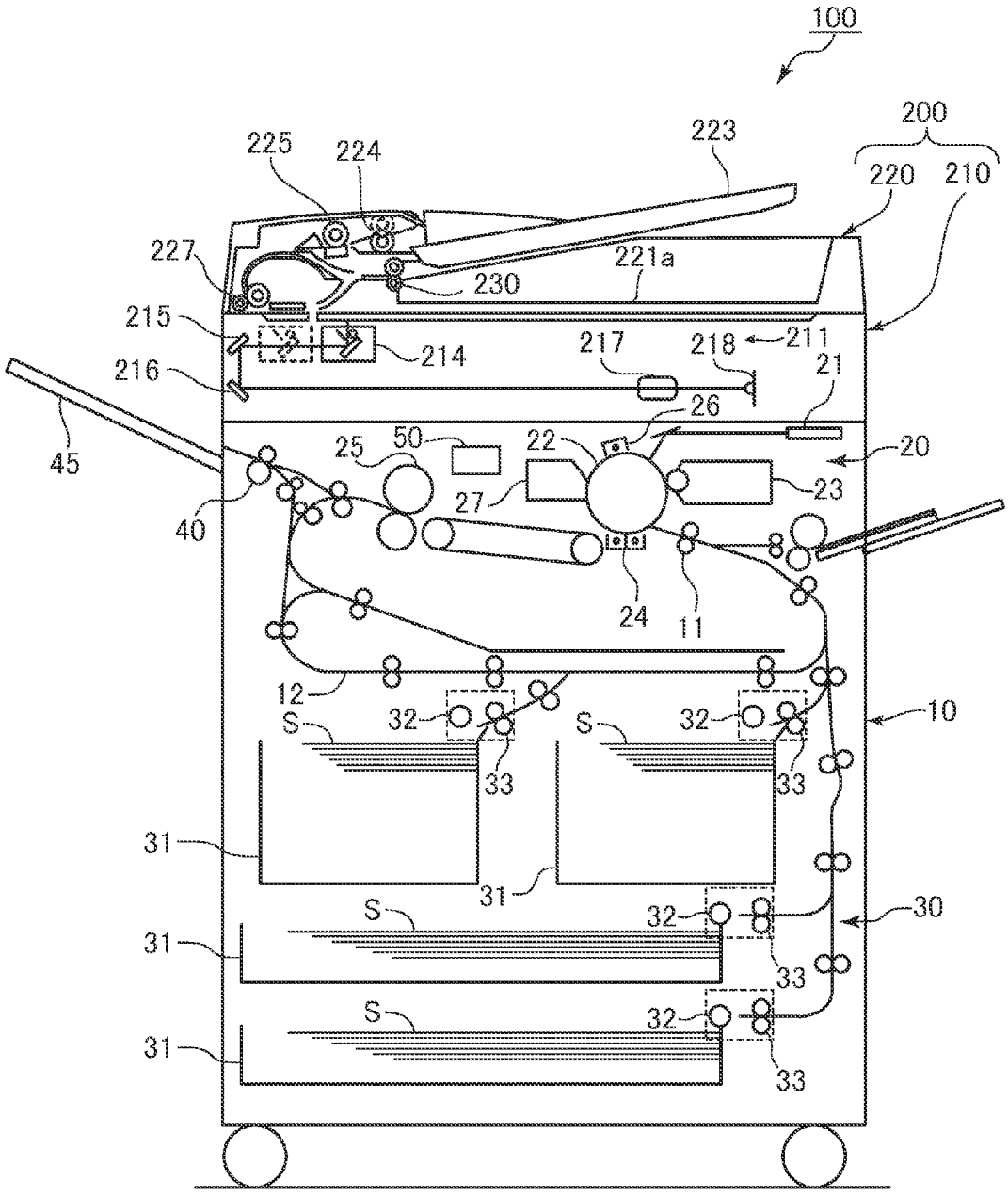
FIG. 1 is a section view schematically showing a printer of a first embodiment of the present invention.
Figure 2:
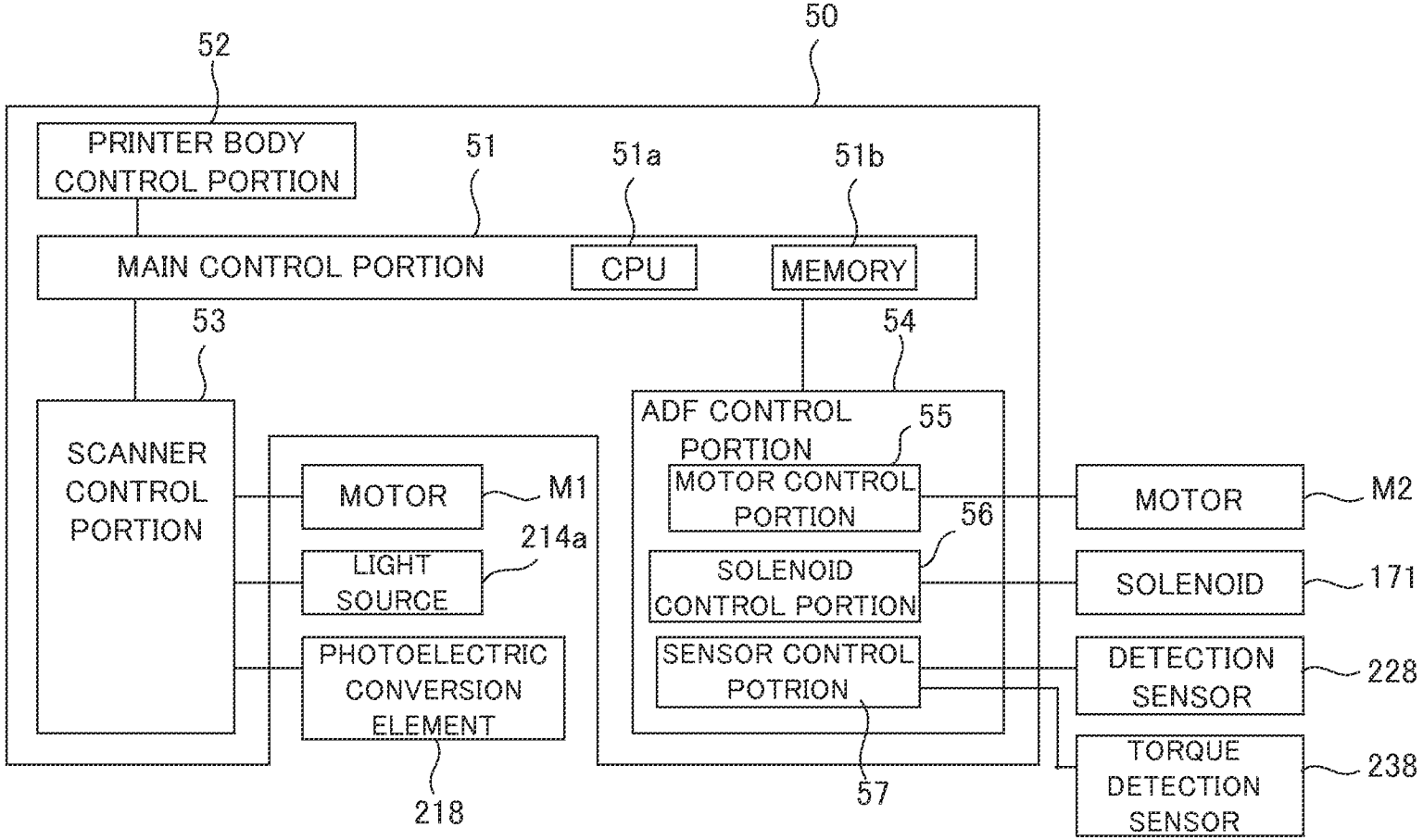
FIG. 2 is a block diagram showing a configuration of a control portion of the printer of the first embodiment.

The printer 100 of the first embodiment of the present invention will be explained with reference to FIGS. 1 through 10. An overall configuration of the printer 100 of the first embodiment will be explained first with reference to FIGS. 1 and 2. FIG. 1 is a section view schematically showing the printer 100 of the embodiment of the present invention. FIG. 2 is a block diagram showing a configuration of a control portion 50 of the printer 100 of the first embodiment. It is noted that a position where a user faces to a manipulation portion not shown for inputting/setting variously to the printer 100 will be referred to as a 'front side' and a back side of the printer 100 will be referred as a 'rear side' in the following explanation. That is, FIG. 1 shows an internal structure of the printer 100 seen from the front side.

As shown in FIG. 1, the printer 100 includes the image reading apparatus 200 configured to be able to read an image of a document G (sheet), a printer body 10 configured to be able to form the image read by the image reading apparatus 200 to the sheet S, and a control portion 50 (see FIG. 2) configured to control these apparatuses. The image reading apparatus 200 includes a scanner portion 210 configured to read the image of the document G and a document feed portion 220 as a sheet feed apparatus configured to be able to feed the document G automatically to the scanner portion 210. It is noted that the scanner portion 210 and the document feed portion 220 will be explained in detail later.

The printer body 10 includes the image forming portion 20 configured to form the image on the sheet S (recording medium), a sheet feed portion 30 configured to feed the sheet S to the image forming portion 20, a discharge roller pair (discharge roller portion) 40 configured to discharge the sheet S on which the image has been formed to out of the apparatus, and a discharged sheet stacking tray (discharged sheet stacking portion) 45 configured to stack the sheet S to be discharged. The image forming portion 20 includes a photosensitive drum 22 on which a toner image is formed, a charger 26 configured to uniformly charge a surface of the photosensitive drum 22, and a laser scanner unit 21 configured to irradiate a laser beam to the photosensitive drum 22 to form an electrostatic latent image on the photosensitive drum 22. The image forming portion 20 also includes a developer 23 configured to develop the electrostatic latent image on the photosensitive drum 22 and to form a toner image, a transfer portion 24 configured to transfer the toner image to the sheet S, a toner recovering portion 27 configured to recover toner left on the developer 23, a fixing portion 25 configured to fix the toner image on the sheet S. The sheet feed portion 30 includes a feed cassette 31 on which the sheet S is stacked, a feed roller 32 configured to feed the sheet S, a separator 33 configured to separate the sheet S one by one.

As shown in FIG. 2, the control portion 50 includes a main control portion 51. The main control portion 51 is connected with a printer body control portion 52 configured to control the image forming portion 20 and others and a scanner control portion 53 controlling the scanner portion 210, and includes a CPU 51*a* configured to drive and control the ADF control portion 54 controlling the document feed portion 220 and others. The ADF control portion 54 includes a motor control portion 55, a solenoid control portion 56, and a sensor control portion 57. The main control portion 51 also includes a memory 51*b* storing various programs, information and others used by the CPU 51*a* in executing image forming and image reading operations. That is, the main control portion 51 integrates operations of the printer body 10, the scanner portion 210 and the document feed portion 220 and a document feeding operation, an operation of reading an image of the document G, and an operation for forming the image to the sheet S are controlled by the main control portion 51.

Next, the image forming operation of the printer 100 will be explained. The image forming operation is carried out integrally by each member of the printer 100 under control of the control portion 50. It is noted that the image forming operation of forming an image on the sheet S on a basis of image information of the document G automatically fed by the document feed portion 220 and read by the scanner portion 210 will be exemplified here. The image reading operation of the image reading apparatus 200 will be described later in detail.

When the image information of the document G fed from the document feed portion 220 and read by the scanner portion 210 is inputted, a laser beam is irradiated from the laser scanner unit 21 to the photosensitive drum 22 on the basis of the inputted image information. By this time, the photosensitive drum 22 is charged in advance by the charger 26, and an electrostatic latent image is formed on a surface of the photosensitive drum 22 as the photosensitive drum 22 is irradiated by the laser beam. Then, a toner image is formed on the photosensitive drum 22 by developing the electrostatic latent image by the developer 23.

In parallel with the operation of forming the toner image on the photosensitive drum 22, the sheet S stored in the feed cassette 31 of the sheet feed portion 30 is fed by the feed roller 32. The sheet S fed by the feed roller 32 is separated one by one by the separator 33. The sheet S separated one by one is synchronized with the toner image on the photosensitive drum 22 by the registration roller 11 and is sent to the transfer portion 24. The transfer portion 24 transfers the toner image on the photosensitive drum 22 to the sheet S sent to the transfer portion 24.

The sheet S on which the toner image has been transferred is heated and pressed at the fixing portion 25 to fix the toner image. The sheet S on which the toner image has been fixed is then discharged to the discharged sheet stacking tray 45 by the discharge roller pair 40 and is stacked sequentially on the discharged sheet stacking tray 45. In a case where images are to be formed on both-sides of the sheet S, the sheet S is conveyed again to the registration roller 11 through a reverse conveying path 12 after fixing the image on the first surface of the sheet S and an image is formed on a second surface of the sheet S by repeating the process described above.

Figure 3:
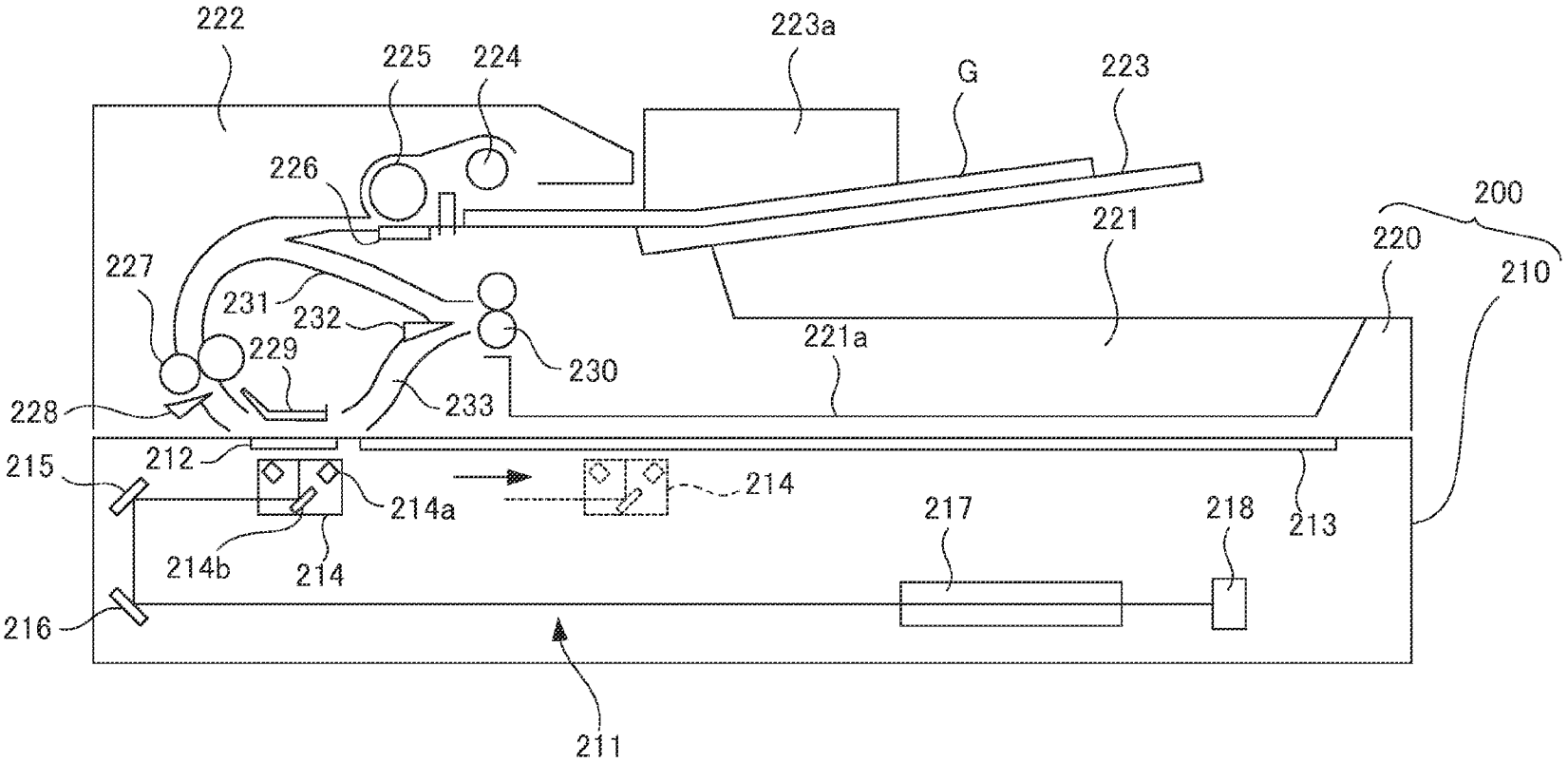
FIG. 3 is a section view schematically showing an image reading apparatus of the first embodiment.
Figure 4:
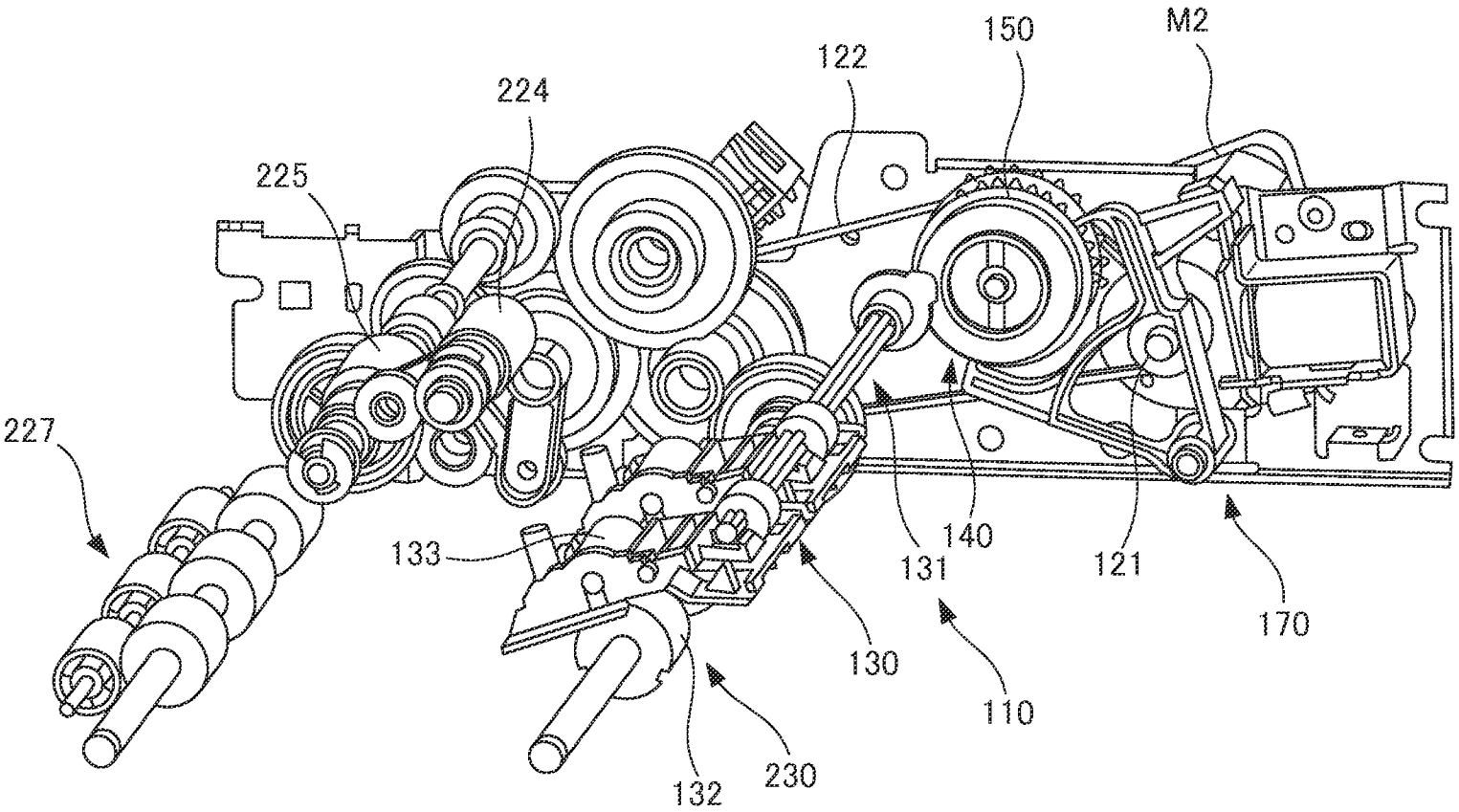
FIG. 4 is a perspective view showing a driving configuration of respective rollers of a document feed portion of the first embodiment.

Next, the image reading apparatus 200 described above will be explained with reference to FIGS. 3 through 10. At first, a schematic configuration of the image reading apparatus 200 will be explained with reference to FIGS. 3 and 4. FIG. 3 is a section view schematically showing the image reading apparatus 200 of the first embodiment, and FIG. 4 is a perspective view showing a drive configuration of respective rollers of a document feed portion 220 of the first embodiment.

As described above, the image reading apparatus 200 includes the scanner portion 210 and the document feed portion 220. In the image reading apparatus 200, the document feed portion 220 is supported by the scanner portion 210 turnably by hinges disposed on the rear side such that a document table glass 213 described later is openable from the front side. The scanner portion 210 and the document feed portion 220 will be specifically explained below.

As shown in FIG. 3, the scanner portion 210 includes an image reading portion 211 configured to read the image of the document G, the platen glass 212, and a document table glass 213 arrayed with the platen glass 212.

The image reading portion 211 includes a scanner unit 214 having a light source 214*a* irradiating the document G, a mirror 214*b* guiding a reflection light from the document G, and mirrors 215 and 216 guiding the reflection light from the scanner unit 214. The image reading portion 211 also includes a lens 217 collecting the guided reflection light, and a photoelectric conversion element 218 configured to photoelectrically convert the collected reflection light and to output it as the image information.

The scanner unit 214 is connected to a driving belt not shown and is movable between a solid line position (under the platen glass 212) shown in FIG. 3 and a broken line position (under the document table glass 213) in FIG. 3 by being driven by a motor M1 (see FIG. 2). It is noted that the position of the scanner unit 214 can be known by a position sensor not shown and a rotation pulse number of the motor M1. A mode of reading the document G moving on the platen glass 212 while halting the scanner unit 214 at the solid line position will be referred to as a 'skimming' mode and a mode of reading the document G placed on the document table glass 213 while moving the scanner unit 214 from the broken line position will be referred to as a 'fixed reading' mode.

The document feed portion 220 includes a document table cover 221 supported turnably to the scanner portion 210 and a feed apparatus (ADF) 222 configured to automatically feeding the document G to a predetermined reading position (above the platen glass 212) in skimming the document G. The document table cover 221 is supported by the scanner portion 210 so as to be able to open the platen glass 212 and the document table glass 213 and is configured to be able to press the document G so that the document G placed on the document table glass 213 does not move in performing the fixed reading. A document stacking portion 221 on which the document G which has been discharged out of the apparatus after skimming is stacked is provided at an upper surface of the document table cover 221.

The feed apparatus 222 includes a document stacking tray 223 on which the document G is stacked, a document feed roller 224 feeding the document G stacked on the document stacking tray 223, and a separation roller 225 and a separation pad 226 separating the document G one by one. The feed apparatus 222 also includes a conveying roller pair 227 aligning a front end of the document G and conveying the document G, a detection sensor 228 detecting that the document G has reached the conveying roller pair 227, and a white board 229 stabilizing conveyance of the document G above the platen glass 212. The feed apparatus 222 also includes a discharge roller pair 230 discharging the document G which has been read out of the apparatus, a switching member 232 guiding the document G to a reverse conveying path 231, and a separating mechanism 110 configured to contact/separate rollers of the discharge roller pair 230 from each other (see FIG. 4).

The document stacking tray 223 includes a pair of width direction restricting plates 223*a* provided slidably in a width direction of the document G. The pair of width direction restricting plates 223*a* is configured to restrict the width direction of the document G stacked on the document stacking tray 223, so that stability in feeding the document G is assured. The document feed roller 224 is provided above a document feed position downstream in a document feed direction of the document stacking tray 223 and is located at a broken line position shown in FIG. 1 as its home position so as not to hinder an operation of an operator setting the document G. In response to a start of a document G feed operation, the document feed roller 224 moves downward (a solid line position shown in FIG. 1) from its home position, abuts against an upper surface of the document G and feeds the document G. It is noted that the document feed roller 224 and the separation roller 225 are connected to a motor M2 (see FIG. 2) through a motor pulley 121, a toothed belt 122, and a gear train as shown in FIG. 4 and are driven by the motor M2. It is noted that the document feed roller 224 is lifted/lowered by a solenoid not shown.

The conveying roller pair 227 is provided downstream in the document feeding direction of the separation roller 225 and conveys the document G to the predetermined reading position above the platen glass 212 while aligning the front end of the document G. It is noted that while the conveying roller pair 227 is driven by the motor M2 similarly to the document feed roller 224 and the separation roller 225, the conveying roller pair 227 is configured to always rotate in the document feeding direction (rotation in a feed forward direction). For instance, the conveying roller pair 227 is connected to the motor M2 through a one-way clutch. The conveying roller pair 227 may be configured to be driven by a motor other than the motor M2. In such a case, the conveying roller pair 227 aligns the front end of the document G fed by being separated one by one by looping the front end of the document G by abutting the front end against a nip portion. After that, the conveying roller pair 227 rotates to convey the document G above the platen glass 212. The white board 229 is disposed above the platen glass 212 with a certain gap from the platen glass 212 and guides the document G whose front end has been aligned by the conveying roller pair 227 so that the document G moves stably above the platen glass 212.

The discharge roller pair 230 is provided at a downstream end of a document discharge path 233 provided downstream in the document feeding direction of the white board 229, and includes a driving discharge roller 132 connected to the motor M2 and configured to be able to normally and reversely rotate and a driven discharge roller 133 rotating by being driven by the driving discharge roller 132. The driving discharge roller 132 is connected to the motor M2 through the motor pulley 121, the toothed belt 122 and others, normally rotates to convey the document G to the document stacking portion 221*a* and reversely rotates to convey the document G to the reverse conveying path 231. A switching member 232 is provided at a branch between the document discharge path 233 and the reverse conveying path 231 and switches a conveying path of the document G. The separating mechanism 110 is configured to be able to contact/separate the driven discharge roller 133 to/from the driving discharge roller 132.

Figure 5:
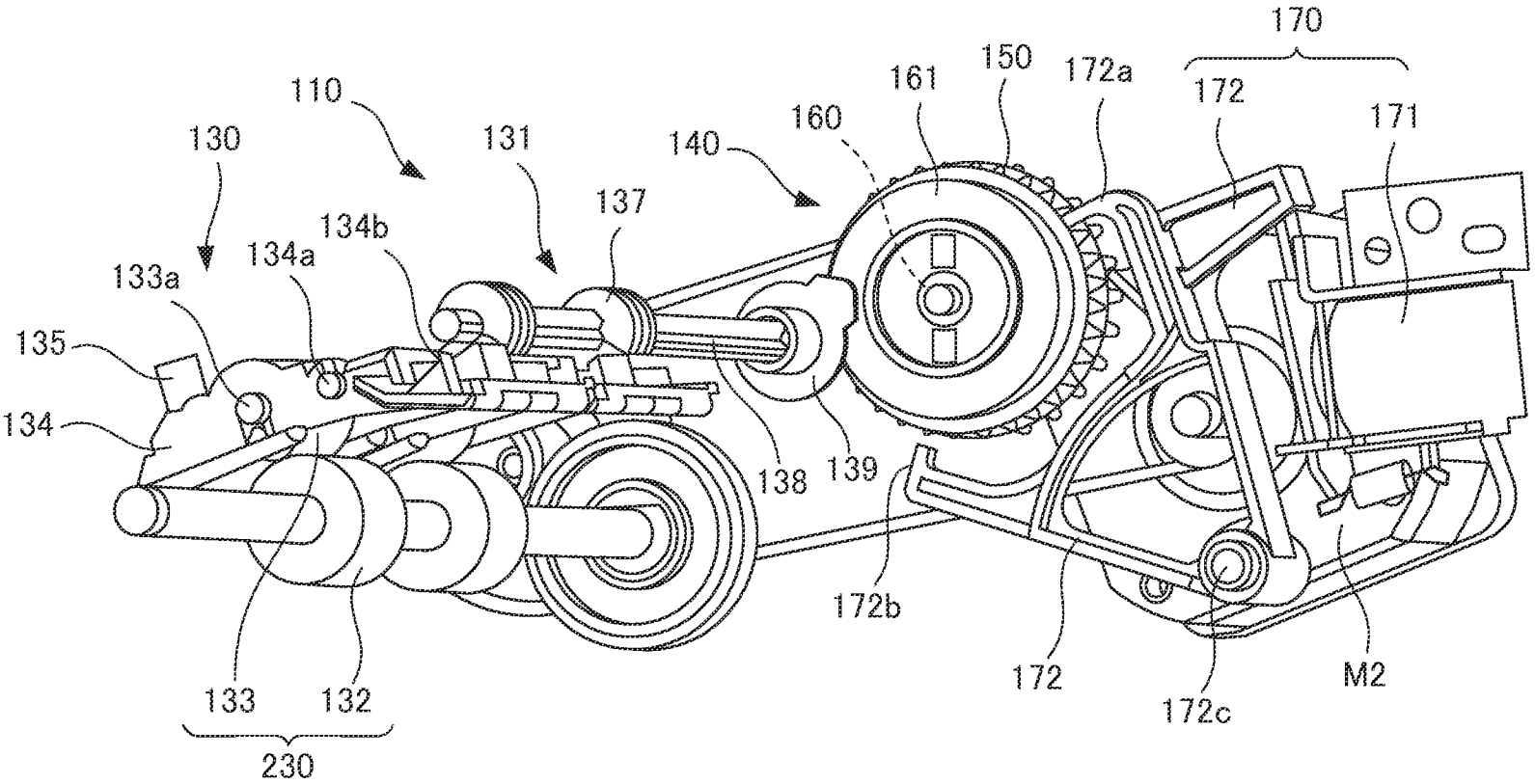
FIG. 5 is a perspective view showing a separating mechanism configured to contact and separate a discharge roller pair of the first embodiment.
Figure 6:
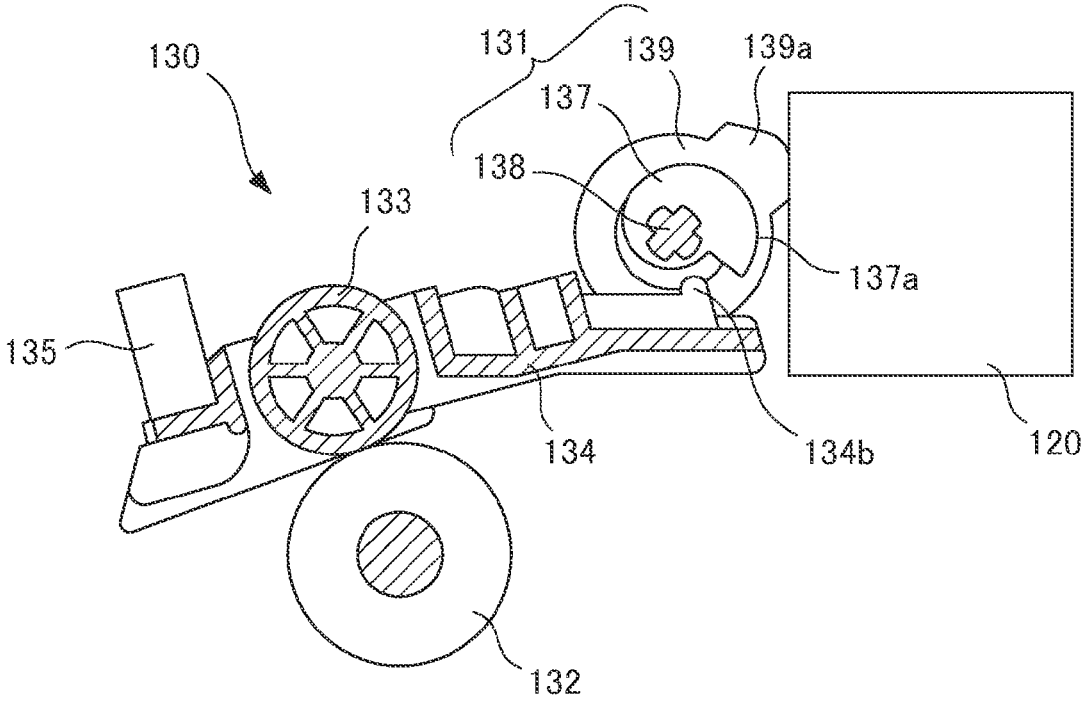
FIG. 6 is a section view showing a support portion and an swing mechanism of the first embodiment.
Figure 7:
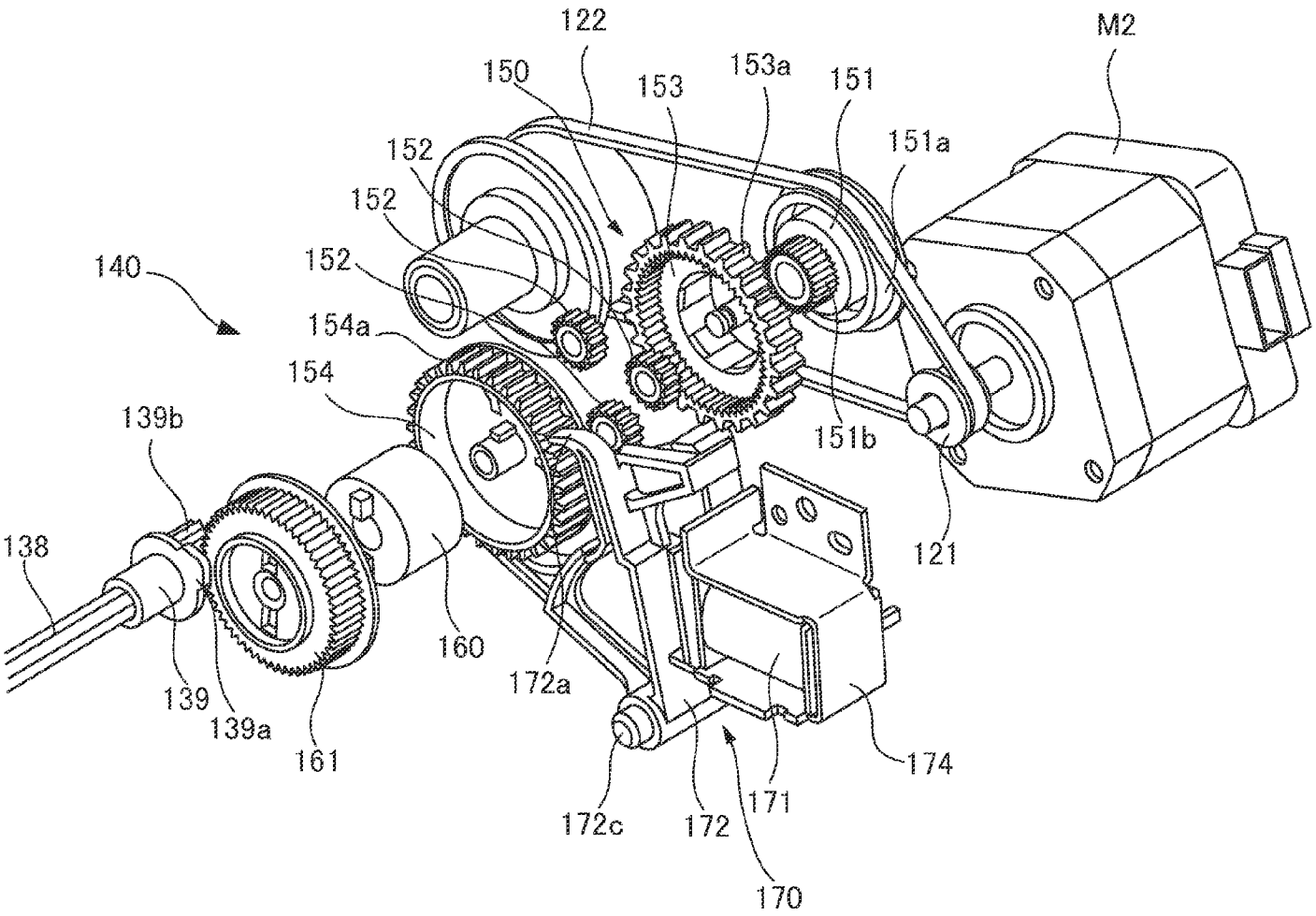
FIG. 7 is an exploded assembly diagram showing a planetary gear mechanism, a switching portion and others of the first embodiment.
Figure 8:
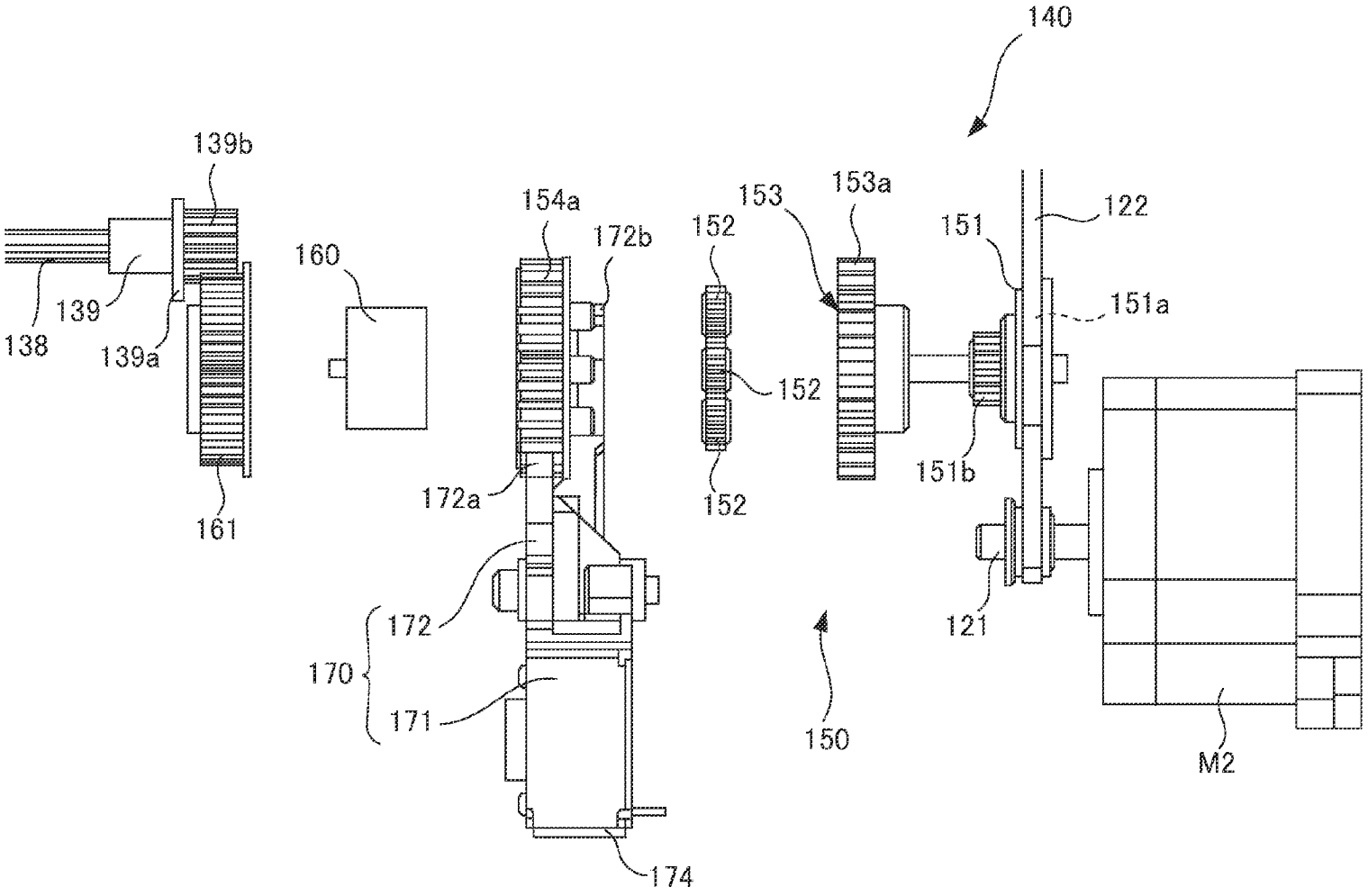
FIG. 8 is a plan view showing the planetary gear mechanism, the switching portion and others of the first embodiment.

Here, the separating mechanism 110 separating the driven discharge roller 133 will be explained specifically with reference to FIGS. 5 through 9. At first, a schematic configuration of the separating mechanism 110 will be explained with reference to FIGS. 5 through 8. FIG. 5 is a perspective view showing the separating mechanism configured to contact/separate the discharge roller pair 230 of the first embodiment. FIG. 6 is a section view showing a support portion and an swing mechanism. FIG. 7 is an exploded assembly diagram showing a planetary gear mechanism, a switching portion and others. FIG. 8 is a plan view showing the planetary gear mechanism, the switching portion and others.

As shown in FIG. 5, the separating mechanism 110 includes a support portion 130 configured to swingably support the driven discharge roller 133, a cam mechanism 131 as an swing mechanism swinging the support portion 130, and a drive connecting/disconnecting portion 140 configured to be able to connect/disconnect transmission of drive from the motor M2 to the cam mechanism 131. In the present embodiment, the motor M2 that normally or reversely rotates the driving discharge roller 132 is used as a driving source of the separating mechanism 110, and the separating mechanism 110 is driven by input rotations generated by the motor M2. It is noted that while the motor M2 is commonly used as the driving source for driving the separating mechanism 110 and the driving discharge roller 132 in the present embodiment, it is also possible to provide separate motors.

The support portion 130 includes a support member 134 rotatably supporting the driven discharge roller 133 and a bias spring 135 (bias member) biasing the support member 134 such that the driven discharge roller 133 is in pressure contact with the driving discharge roller 132. The support member 134 is supported swingably centering on a swing shaft 134*a* and rotatably supports the driven discharge roller 133 centering on a rotation shaft 133*a* located substantially in parallel with the swing shaft 134*a* at one side of the swing shaft 134*a*. Still further, a convex portion 134*b* configured to be able to engage with the cam mechanism 131 is formed at an end of another side of the swing shaft 134*a* of the support member 134. That is, when the convex portion 134*b* is pressed down by the cam mechanism 131, the support member 134 swings centering on the swing shaft 134*a* and the driven discharge roller 133 separates from the driving discharge roller 132. The bias spring 135 biases the support member 134 toward the driving discharge roller 132 at an end of the one side of the swing shaft 134*a* driven discharge roller 133 comes into pressure contact with the driving discharge roller 132 by a bias force of the bias spring 135 and a nip pressure for conveying the document G is brought about.

As shown in FIG. 6, the cam mechanism 131 includes a cam 137 having a cam surface 137*a* engageable with the convex portion 134*b*, a cam shaft 138 connected with the cam 137, and a cam driving gear 139 rotating the cam shaft 138. The cam 137 is configured such that the cam surface 137*a* engages with the convex portion 134*b* when the cam shaft 138 rotates and in response to the rotation, the cam surface 137*a* gradually presses down the convex portion 134*b*. The cam driving gear 139 is connected at an end portion of the cam shaft 138 and includes a convex portion 139*a* formed to butt against an opposed wall (restricting portion) 120 and a gear portion 139*b* connected with the drive connecting/disconnecting portion 140. The cam mechanism 131 is configured such that the cam shaft 138 stops at a first position when one end of the convex portion 139*a* rotates in a direction B described later and butts against the opposed wall 120. The cam mechanism 131 is also configured such that the cam shaft 138 stops at a second position when another end of the convex portion 139*a* rotates in a direction A described later and butts against the opposed wall 120. That is, a rotation range of the cam shaft 138 is restricted by the convex portion 139*a* and the opposed wall 120 between the first and the second position. Then, because the cam surface 137 does not engage with the convex portion 134*b* when the cam shaft 138 is located at the first position, the driven discharge roller 133 is in pressure contact with the driving discharge roller 132. When the cam shaft 138 is located at the second position, the cam surface 137*a* presses down the convex portion 134*b*, so that the driven discharge roller 133 is put into a state in which the driven discharge roller 133 is separated from the driving discharge roller 132. A torque detection sensor 238 (see FIG. 2) detects a torque of the cam shaft 138 and the sensor control portion 57 can detect that the convex portion 139*a* has butted against the opposed wall 120 on a basis of the torque of the cam shaft 138 detected by the torque detection sensor 238.

As shown in FIGS. 7 and 8, the drive connecting/disconnecting portion 140 includes a planetary gear mechanism 150 connected to the motor M2, a switching portion 170 changing an output destination of the planetary gear mechanism 150, a torque limiter 160 and an output gear 161.

The planetary gear mechanism 150 includes a sun gear 151, a plurality of planet gears (three in the present embodiment) 152, an inner tooth gear 153, i.e., a first rotary component, a planet carrier 154, i.e., a second rotary component, and is configured to be able to transmit the drive of the motor M2 to the torque limiter 160. The sun gear 151 includes a pulley portion 151*a* connected to the motor M2 through a motor pulley 121 and a toothed belt 122, and a gear portion 151*b*. Each of the plurality of planet gears 152 is meshed with the gear portion 151*b* of the sun gear 151. The inner tooth gear 153 is meshed with the plurality of planet gears 152 by an inner circumferential surface thereof. A planet carrier 154 rotatably supports each of the plurality of planet gears 152 and rotates by orbital motions of the plurality of planet gears 152. A locked portion 154*a* engageable with a first locking claw (first locking portion) 172*a* of a moving member (rotation restricting member) 172 described later is formed around an outer circumferential surface of the planet carrier 154, and a locked portion 153*a* engageable with a second locking claw (second locking portion) 172*b* of the moving member 172 described later is formed around an outer circumferential surface of the inner tooth gear 153.

The switching portion 170 includes a moving member 172 and a solenoid 171. The moving member 172 includes a first locking claw 172*a* engageable with the locked portion 154*a* of the planet carrier 154 and the second locking claw 172*b* engageable with the locked portion 153*a* of the inner tooth gear 153 and is configured to be able to turn centering on a turning shaft 172*c*. The first locking claw 172*a* locks rotation of the planet carrier 154 by engaging with the locked portion 154*a* and puts the planetary gear mechanism 150 into a cutoff state in which the transmission of the power from the motor M2 to the cam mechanism 131 is cut off. The second locking claw 172*b* locks rotation of the inner tooth gear 153 by engaging with the locked portion 153*a* and puts the planetary gear mechanism 150 into a transmission state in which the power from the motor M2 can be transmitted to the cam mechanism 131. The solenoid 171 is configured so as to be able to press an arm member 173 (see FIG. 9A) whose one end is linked to the moving member 172. A coil spring 175 (see also FIG. 9A), i.e., a bias portion, is disposed between another end of the arm member 173 and a bracket 174 fixing the solenoid 171 and biases the arm member 173 so that the first locking claw 172*a* of the moving member 172 engages with the locked portion 154*a*. When the solenoid 171 is energized, a plunger 171*a* of the solenoid 171 presses the arm member 173 by resisting against the bias force of the coil spring 175 and the second locking claw 172*b* of the moving member 172 engages with the locked portion 153*a*. That is, the switching portion 170 can switch the planetary gear mechanism 150 to the transmission state and the cutoff state by the moving member 172 turning by the solenoid 171 and the coil spring 175.

The torque limiter 160 is interposed between the planet carrier 154 and the output gear 161 and transmits rotation of the planet carrier 154 to the output gear 161. The torque limiter 160 is configured such that an input side turns idly and no driving force is transmitted to the cam driving gear 139 when the convex portion 139*a* of the cam driving gear 139 butts against the opposed wall 120 and rotation of the cam shaft 138 is restricted. It is noted that a torque capacity of the torque limiter 160 is set such that the capacity fully exceeds an operating torque of the cam mechanism 131 and the torque limiter 160 will not start to turn idly before a rotational operation of the cam mechanism 131 is completed. The output gear 161 transmits the driving force of the motor M2 transmitted through the torque limiter 160 to the cam driving gear 139.

Figure 9A:
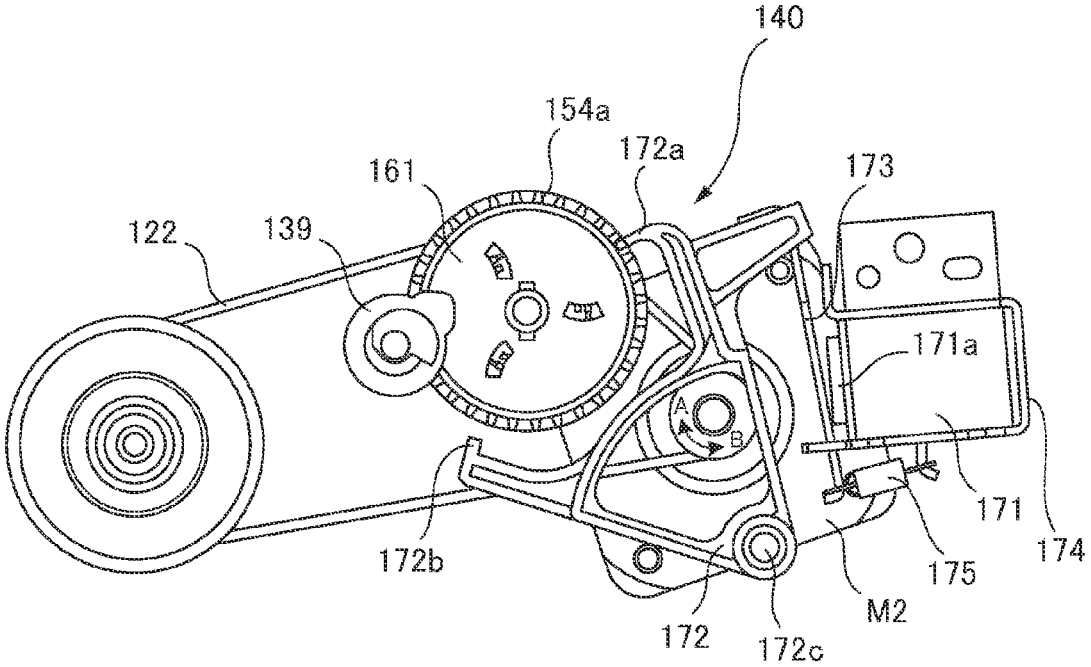
FIG. 9A illustrates transmission of a driving force from a motor to a cam driving gear of the first embodiment and shows a state in which the driving force from the motor is cut off by the planetary gear mechanism.
Figure 9B:
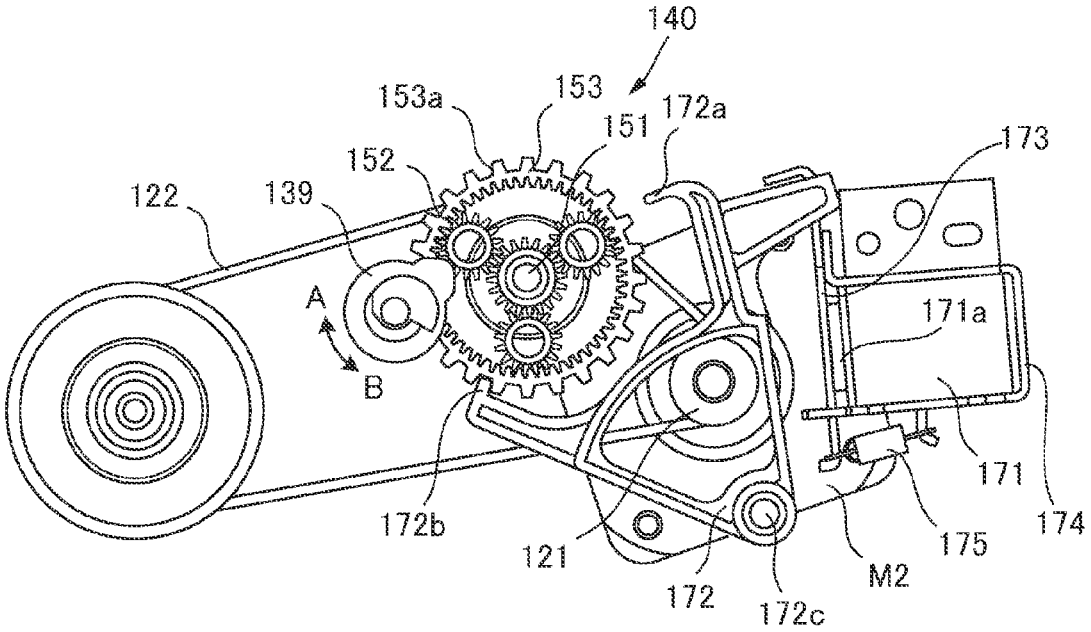
FIG. 9B illustrates transmission of the driving force from the motor to the cam driving gear of the first embodiment and shows a state in which the driving force from the motor is connected to the swing mechanism through the planetary gear mechanism.
Figure 10:
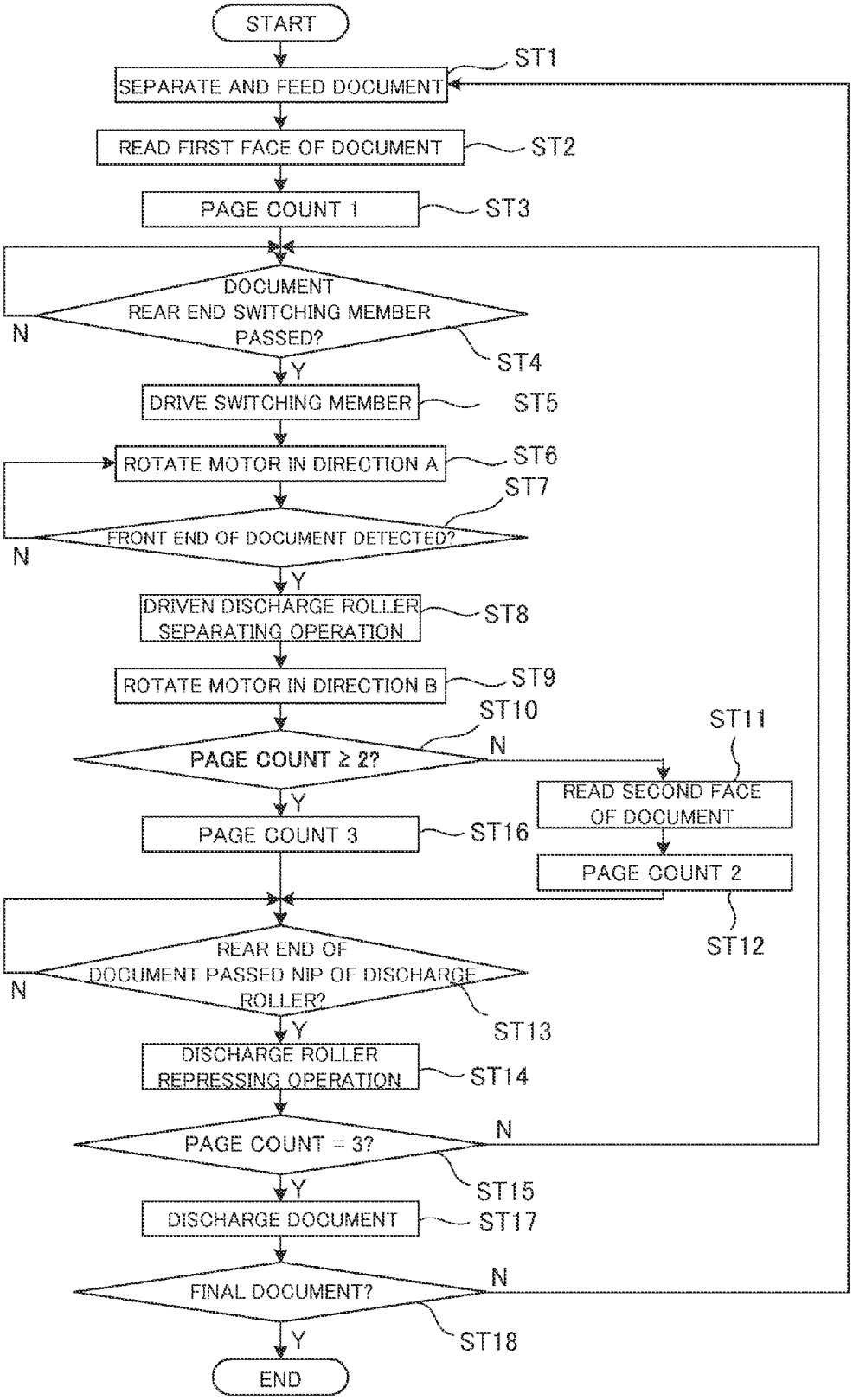
FIG. 10 is a flowchart of an image reading operation performed by the image reading apparatus of the first embodiment.

Next, the image reading operation of the image reading apparatus 200 configured as described above will be explained with reference to FIGS. 9A and 9B and along a flowchart shown in FIG. 10. It is noted that the skimming of the both surface of the document G will be explained in the present embodiment. FIG. 9A illustrates the transmission of the driving force from the motor to the cam driving gear of the first embodiment and shows a state in which the driving force from the motor is cut off by the planetary gear mechanism. FIG. 9B illustrates the transmission of the driving force from the motor to the cam driving gear and shows a state in which the driving force from the motor is connected to the swing mechanism through the planetary gear mechanism. FIG. 10 is a flowchart of the image reading operation performed by the image reading apparatus of the first embodiment.

As shown in FIG. 10, in response to an input of a signal of starting the image reading operation, the motor control portion 55 rotates the motor M2 in a direction B (in a second direction) as shown in FIG. 9B. At this time, the cam shaft 138 of the cam mechanism 131 is located at the first position and the driven discharge roller 133 is in pressure contact with the driving discharge roller 132. The first position is a position of the cam shaft 138 when one end of the convex portion 134*b* formed on the swing shaft 134*a* butts against the opposed wall 120 as described above. It is noted that a rotation direction opposite from the direction B will be referred to as a direction A (first direction). In the explanation below, rotation directions of the planet gear 152 having a shaft in parallel with a rotational shaft of the motor M2, the inner tooth gear 153, the planet carrier 154, the output gear 161 and the cam driving gear 139 will be explained by using the direction A or B described above.

When the motor M2 rotates in the direction B, the document feed roller 224 rotates in the feed direction and starts to drop toward the document feed position by a solenoid not shown. Then, when the document feed roller 224 abuts against the document G stacked on the document stacking tray 223, the document feed roller 224 stops to drop and the document G is fed by the rotating document feed roller 224. In a case where the document feed roller 224 feeds two or more documents G at this time (overlap feeding), the separation roller 225 and the separation pad 226 separate and feed the plurality of document Gs one by one (Step ST1).

The document G thus separated and fed is conveyed to a predetermined reading position by the conveying roller pair 227 and an image of a first face (surface) of the document G is read by the scanner unit 214 located under the platen glass 212 (Step ST2). When the image of the first face (surface) is read, a page count 1 is inputted to the memory 51*b* (Step ST3). It is noted that because the motor M2 rotate in the direction B, the driving discharge roller 132 rotates in the direction A and is in a state in which the document G can be conveyed out of the apparatus. The conveying roller pair 227 is configured to rotate in the feed forward direction regardless of the rotation direction of the motor M2 as described above.

Next, when the document G is conveyed by the discharge roller pair 230 toward the outside of the apparatus and a rear end of the document G passes through the switching member 232 (Step ST4), the main control portion 51 turns the switching portion 232 and the motor control portion 55 rotates the motor M2 in the direction A. Thereby, the driving discharge roller 132 rotates in the direction B and the document G is switched back and conveyed to the reverse conveying path 231 (Steps ST5 and ST6).

At this time, the document feed roller 224 elevates to the home position and no document G is fed by the document feed roller 224. The planetary gear mechanism 150 is in the cutoff state in which no driving force is transmitted to the cam mechanism 131 and no operation for separating the driven discharge roller 133 is carried out. Specifically, in the state in which no operation for separating the driven discharge roller 133 is carried out, the first locking claw 172*a* of the moving member 172 is engaged with the locked portion 154*a* by the bias force of the coil spring 175 and the planet carrier 154 is locked as shown in FIG. 9A. At this time, the solenoid 171 is not energized and the motor M2 rotates in the direction A, so that the sun gear 151 rotates in the direction A and the plurality of planet gears 152 rotate in the direction B without revolving around the sun gear 151. Then, because the planet gears 152 rotate in the direction B, the inner tooth gear 153 rotates idly in the direction A. That is, because the planet carrier 154 is locked by the first locking claw 172*a* of the moving member 172, the driving force inputted from the motor M2 is outputted to the inner tooth gear 153, i.e., an output member, not linked to other members, and is not transmitted to the cam mechanism 131. Therefore, because the driving force of the motor M2 is transmitted such that the inner tooth gear 153 idly rotates even if the motor M2 rotates in the direction A for separating the driven discharge roller 133 from the driving discharge roller 132 in the state in which the driven discharge roller 133 is in pressure contact with the driving discharge roller 132, it is possible to maintain the nip between the driven discharge roller 133 and the driving discharge roller 132.

Next, when the detection sensor 228 detects the front end of the document G switch-backed as described above, the solenoid control portion 56 switches the planetary gear mechanism 150 from the cutoff state to the transmission state and controls such that the driven discharge roller 133 separates from the driving discharge roller 132 (Steps ST7, ST8). Specifically, the solenoid control portion 56 turns the moving member 172 by energizing the solenoid 171 and engages the second locking claw 172*b* of the moving member 172 with the locked portion 153*a* of the inner tooth gear 153 as shown in FIG. 9B. At this time, because the motor M2 rotates in the direction A in the state in which the rotation of the inner tooth gear 153 is restricted, the sun gear 151 turns in the direction A and the plurality of planet gears 152 revolves around the sun gear 151 in the direction A while rotating in the direction B. Thereby, the planet carrier 154 rotates while decelerating its speed in the direction A, and the rotation in the direction A of the planet carrier 154, is transmitted to the output gear 161 and the cam driving gear 139 through the torque limiter 160, and the cam shaft 138 of the cam mechanism 131 rotates in the direction B. As a result, the cam shaft 138 moves from the first position to the second position. It is noted that the second position is a position of the cam shaft 138 when the other end of the convex portion 134*b* formed on the swing shaft 134*a* butts against the opposed wall 120 as described above. That is, the cam surface 137*a* of the cam 137 presses down the convex portion 134*b* and the support member 134 turns by resisting against the bias force of the bias spring 135. Thereby, the driven discharge roller 133 swings in the direction of separating from the driving discharge roller 132.

Then, when the cam shaft 138 rotates by a predetermined angle from the first position in the direction B and is positioned at the second position, the convex portion 139*a* of the cam driving gear 139 butts against the opposed wall 120 and the rotation in the direction B of the cam shaft 138 is stopped. It is noted that even though the planet carrier 154 continues to rotate in the direction A even if the rotation in the direction B of the cam shaft 138 is stopped, the rotation will not be transmitted to the components downstream in the drive transmission direction of the torque limiter 160 because the torque limiter 160 cuts off the transmission of the drive to the output gear 161. Thereby, it is possible to stop the cam shaft 138 accurately at the second position and to prevent the planet carrier 154 and others from being damaged by excessive load regardless of accuracy of an operation time of the solenoid 171.

When the rotation of the cam shaft 138 is restricted by the opposed wall 120, the sensor control portion 57 sends a signal to the ADF control portion 54. When the ADF control portion 54 receives the signal, the solenoid control portion 56 turns off the energization of the solenoid 171 and releases the state of the inner tooth gear 153 locked by the moving member 172. Then, the first locking claw 172*a* of the moving member 172 engages with the locked portion 154*a* by the bias force of the coil spring 175 and the moving member 172 locks the planet carrier 154. Thereby, the inner tooth gear 153 rotates idly in the direction A and the planetary gear mechanism 150 is put into the cutoff state in which the transmission of the power of the motor M2 to the cam mechanism 131 is cut off. Thus, the control of separating the driven discharge roller 133 from the driving discharge roller 132 is completed.

After that, in order to be ready to convey the document G whose front and back surfaces are reversed, the motor control portion 55 rotates the motor M2 in the direction B and rotates the driving discharge roller 132 in the direction A (Step ST9). It is noted that switching of the rotation direction of the motor M2 in Step ST9 may be executed before executing Step ST14. Still further, the document G can be conveyed in the feed forward direction by the conveying roller pair 227 even if the driving discharge roller 132 rotates in the direction A before the rear end of the document G passes through the nip between the driving discharge roller 132 and the driven discharge roller 133.

Next, when the page count is smaller than 2, the image of the second face (back surface) of the document G is read and the page count 2 is inputted to the memory 51*b* (Steps ST10 through ST12). Then, if the detection sensor 228 detects that the rear end of the document G switched back and conveyed as described above has passed through the nip between the driving discharge roller 132 and the driven discharge roller 133, the solenoid control portion 56 switches the planetary gear mechanism 150 from the cutoff state to the transmission state and controls such that the driven discharge roller 133 presses the driving discharge roller 132 again (Steps ST13 and ST14). Specifically, the solenoid control portion 56 turns the moving member 172 by energizing the solenoid 171 to release the lock state of the planet carrier 154 locked by the first locking claw 172*a* and engages the second locking claw 172*b* of the moving member 172 with the locked portion 153*a* of the inner tooth gear 153. At this time, because the motor M2 rotates in the direction B in the state in which the rotation of the inner tooth gear 153 is restricted, the sun gear 151 rotates in the direction B and the plurality of planet gears 152 revolves around the sun gear 151 in the direction B while rotating in the direction A. Thereby, the planet carrier 154 rotates in the direction B, the rotation in the direction B of the planet carrier 154 is transmitted to the output gear 161 and the cam driving gear 139 through the torque limiter 160, and the cam shaft 138 of the cam mechanism 131 rotates in the direction A. As a result, the cam shaft 138 moves from the second position to the first position. That is, the cam surface 137*a* of the cam 137 separates from the convex portion 134*b* and the support member 134 turns in the bias direction of the bias spring 135, so that the driven discharge roller 133 presses the driving discharge roller 132 again.

Then, if the cam shaft 138 rotates from the second position in the direction A by the predetermined angle and is positioned at the first position, the convex portion 139*a* of the cam driving gear 139 butts against the opposed wall 120 and the rotation in the direction A of the cam shaft 138 stops. When the rotation of the cam shaft 138 is restricted by the opposed wall 120, the sensor control portion 57 sends a signal to the ADF control portion 54. When the ADF control portion 54 receives the signal, the solenoid control portion 56 turns off the energization of the solenoid 171 and releases the locked state of the inner tooth gear 153 locked by the moving member 172. Then, the moving member 172 locks the planet carrier 154 as the first locking claw 172*a* engages with the locked portion 154*a* by the bias force of the coil spring 175. Thereby, the planetary gear mechanism 150 is put into the cutoff state in which the transmission of the power from the motor M2 to the cam mechanism 131 is cut off. Thus, the control of pressing the driven discharge roller 133 again to the driving discharge roller 132 is completed.

Here, if the page count recorded in the memory 51*b* is not 3, the process returns to Step ST4 to repeat the abovementioned control, and if the page count is 3, the document G is discharged out of the apparatus (Steps ST15 and ST17). Thereby, the document G is discharged out of the apparatus in a state in which the first surface faces downward. If the page count is 2 or more in Step ST10 at this time, the page count '3' is inputted to the memory 51*b* and the process advances to Step ST13 (Step ST16). Then, if the document G discharged out of the apparatus in Step ST17 is a final document in the job, the document reading operation is finished, and if it is not the final document in the job, the process returns to Step ST1 to repeat the abovementioned control (Step ST18).

As described above, the printer 100 of the first embodiment includes the separating mechanism 110 contacting/separating the driven discharge roller 133 of the discharge roller pair 230. The document feed portion 220 of the present embodiment uses the motor M2 which is the driving source of the driving discharge roller 132 also as a driving source of the separating mechanism 110 and provides the planetary gear mechanism 150 in the separating mechanism 110 to use the planetary gear mechanism 150 not only as a change-speed mechanism but also as a clutch mechanism connecting/disconnecting the transmission of the power from the motor M2 to the cam mechanism 131. Therefore, this arrangement makes it possible to configure the document feed portion 220 simply in compact. Then, because the document feed portion 220 is configured simply in compact, it is possible to configure the entire feed apparatus 222 simply in compact.

Still further, while the switching portion 170 includes the solenoid 171 turning the moving member 172, it is possible to apply a small type solenoid because the solenoid 171 is not required to directly lift the driven discharge roller 133 and is not required to output a large driving torque. This arrangement makes it possible to provide the contact/separate mechanism separating the driven discharge roller 133 with a simple configuration without using complicated control. It is also possible to prevent the contact/separate mechanism from being enlarged. As a result, a component cost may be cut.

Still further, the drive connecting/disconnecting portion 140 includes the torque limiter 160. The torque limiter 160 prevents a rotational force from the planet carrier 154 from being inputted to the cam mechanism 131 whose rotation is restricted by the opposed wall 120. Therefore, it is possible to prevent an unnecessary rotation force from being inputted to the cam mechanism 131 and to prevent the components from being damaged or worn with the simple configuration.

Second Embodiment

Figure 11:
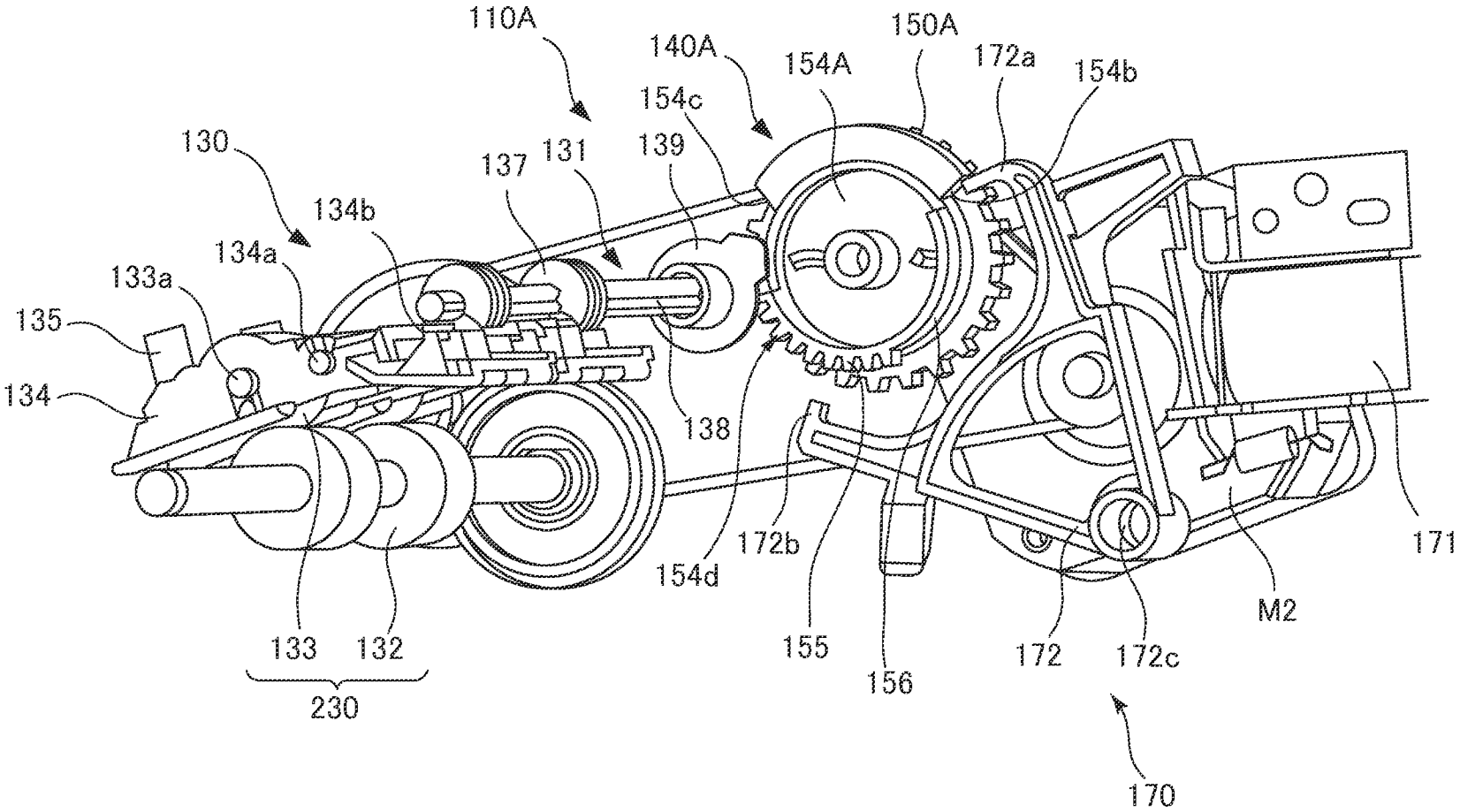
FIG. 11 is a perspective view showing a separating mechanism separating a discharge roller pair of a second embodiment of the invention.

Next, a printer of a second embodiment of the present invention will be explained with reference to FIGS. 11 and 12. The printer of the second embodiment is different from the printer of the first embodiment regarding a drive connecting/disconnecting portion configured to connect/disconnect a drive from the motor. Therefore, the difference from the first embodiment, i.e., the drive connecting/disconnecting portion, will be mainly explained in the second embodiment, and an explanation of the other components will be omitted here. At first, a schematic configuration of the drive connecting/disconnecting portion 140A will be explained with reference to FIG. 11. FIG. 11 is a perspective view showing the drive connecting/disconnecting portion 140A of the second embodiment.

As shown in FIG. 11, the drive connecting/disconnecting portion 140A of the second embodiment includes a planetary gear mechanism 150A connected to the motor M2 and a switching portion 170 changing an output destination of the planetary gear mechanism 150A. The planetary gear mechanism 150A includes the sun gear 151, the plurality of planet gears 152, the inner tooth gear 153, and the planet carrier 154A. Locked portions 154*b* and 154*c* engageable with a first locking claw 172*a* of the moving member 172 and a tooth lacking gear 154*d* are formed around the outer circumferential surface of the planet carrier 154A. Still further, in parallel with an axial direction of the sun gear 151 a tooth lacking gear 154*d* is formed together with the locked portions 154*b* and 154*c* around the outer circumferential surface of the planet carrier 154A. The tooth lacking gear 154*d* includes a tooth portion (gear portion) 155 meshing with a gear portion (driven gear) 139*b* of the cam driving gear 139 and rotates the cam shaft 138 by a predetermined angle between the first and second positions and a tooth lacking portion 156 formed continuously from the tooth portion 155 and cuts off the transmission of the power to the cam shaft 138 by bringing about a non-meshed state with the gear portion 139*b*.

In the case where the cam shaft 138 of the cam mechanism 131 is positioned at the first position, one end of the convex portion 139*a* of the cam driving gear 139 butts against the opposed wall 120, the rotation in the direction A of the cam shaft 138 is restricted, and the tooth lacking portion 156 of the tooth lacking gear 154*d* faces the gear portion 139*b* of the cam driving gear 139. Accordingly, the rotation in the direction B of the tooth lacking gear 154*d* is not transmitted to the gear portion 139*b* of the cam driving gear 139 (see FIGS. 12A and 12B). In the case where the cam shaft 138 is positioned at the second position, another end of the convex portion 139*a* of the cam driving gear 139 butts against the opposed wall 120, the rotation in the direction B of the cam shaft 138 is restricted, and the tooth lacking portion 156 of the tooth lacking gear 154*d* faces the gear portion 139*b* of the cam driving gear 139. Accordingly, the rotation in the direction A of the tooth lacking gear 154*d* is not transmitted to the gear portion 139*b* of the cam driving gear 139 (see FIGS. 12A and 12B).

That is, as compared to the drive connecting/disconnecting portion 140 of the first embodiment, the drive connecting/disconnecting portion 140A of the second embodiment is configured such that the torque limiter 160 and the output gear 151 transmitting the drive to the cam mechanism 131 are omitted and such that the cam shaft 138 rotates by a predetermined angle between the first and second positions by meshing the tooth portion 155 of the tooth lacking gear 154*d* with the gear portion 139*b* of the cam driving gear 139. It is noted that a number of teeth of the teeth lacking gear 154*d* of the planet carrier 154A is set such that the cam shaft 138 rotates by the predetermined angle between the first and second positions.

Figure 12A:
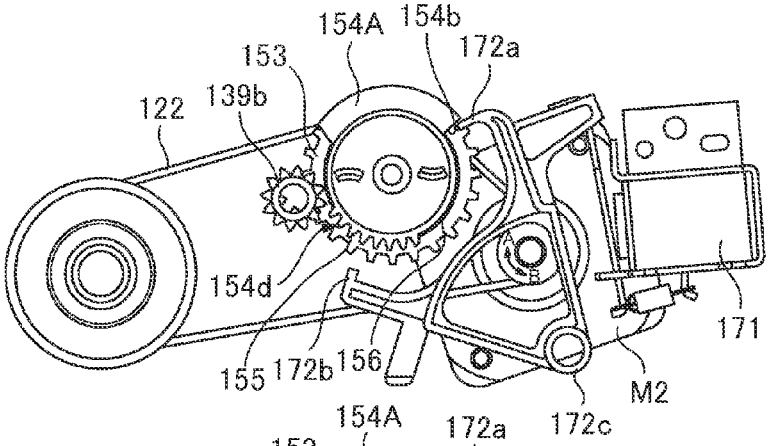
FIG. 12A illustrates transmission of a driving force from a motor to a cam driving gear of the second embodiment and shows a state in which the driving force from the motor is cut off by a planetary gear mechanism in a state in which a driven discharge roller in pressure contact with a driving discharge roller.
Figure 12B:
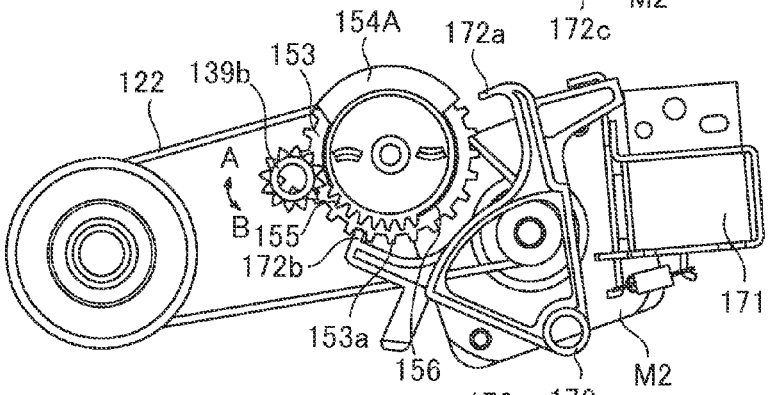
FIG. 12B illustrates transmission of the driving force from the motor to the cam driving gear of the second embodiment and shows a state in which the driving force from the motor is connected to the swing mechanism through the planetary gear mechanism in a state in which the driven discharge roller is in pressure contact with the driving discharge roller.
Figure 12C:
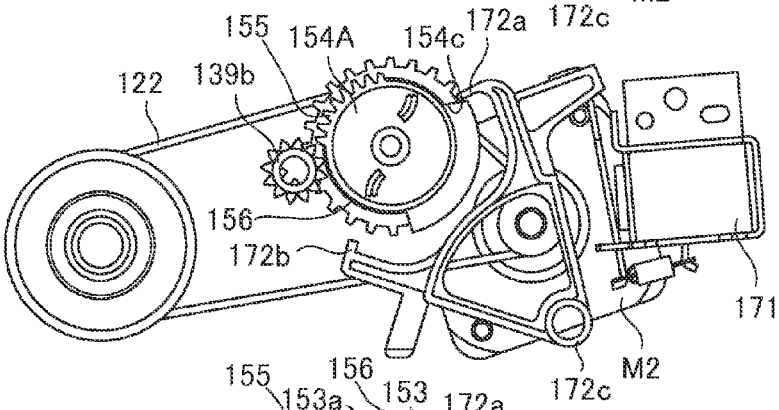
FIG. 12C illustrates transmission of a driving force from the motor to the cam driving gear of the second embodiment and shows a state in which the driving force from the motor is cut off by the planetary gear mechanism in a state in which the driven discharge roller is separated from the driving discharge roller.
Figure 12D:
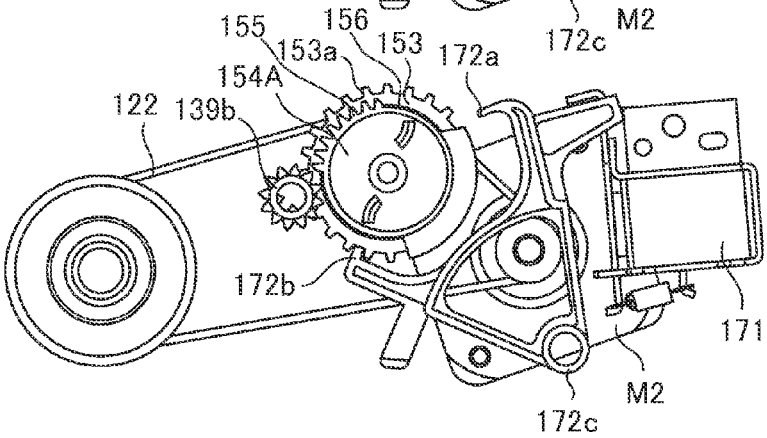
FIG. 12D illustrates transmission of the driving force from the motor to the cam driving gear of the second embodiment and shows a state in which the driving force from the motor is connected to the swing mechanism through the planetary gear mechanism in a state in which the driven discharge roller is separated from the driving discharge roller.

Because an image reading operation performed by the image reading apparatus 200 having the drive connecting/disconnecting portion 140A constructed as described above is similar to that of the first embodiment described above, an explanation thereof will be omitted here. Then, the operation for separating the driven discharge roller 133 described in Step ST8 in FIG. 10 and the operation for pressing the driven discharge roller 133 again described in Step ST14 will be explained with reference to FIGS. 12A through 12D. FIG. 12A illustrates the transmission of the driving force from the motor to the cam driving gear of the second embodiment and shows a state in which the driving force from the motor is cut off by the planetary gear mechanism in a state in which the driven discharge roller is in pressure contact with the driving discharge roller. FIG. 12B illustrates the transmission of the driving force from the motor to the cam driving gear of the second embodiment and shows a state in which the driving force from the motor is connected to the swing mechanism through the planetary gear mechanism in the state in which the driven discharge roller is in pressure contact with the driving discharge roller, FIG. 12C illustrates the transmission of the driving force from the motor to the cam driving gear and shows a state in which the driving force from the motor is cut off by the planetary gear mechanism in a state in which the driven discharge roller is separated from the driving discharge roller, and FIG. 12D illustrates the transmission of the driving force from the motor to the cam driving gear and shows a state in which the driving force from the motor is connected to the swing mechanism through the planetary gear mechanism in a state in which the driven discharge roller is separated from the driving discharge roller.

In a state right before the operation for separating the driven discharge roller 133 shown in Step ST8 in FIG. 10, the cam shaft 138 is located at the first position and the driven discharge roller 133 is in pressure contact with the driving discharge roller 132. Specifically, as shown in FIG. 12A, the planet carrier 154A is locked by the first locking claw 172*a* of the moving member 172 engaging with the locked portion 154*b* by the bias force of the coil spring 175. At this time, the solenoid 171 is not energized and the motor M2 rotates in the direction A, so that the sun gear 151 rotates in the direction A and the plurality of planet gears 152 rotate in the direction B without revolving around the sun gear 151. Then, because the planet gears 152 rotate in the direction B, the inner tooth gear 153 rotates idly in the direction A. That is, because the planet carrier 154A is locked by the first locking claw 172*a* of the moving member 172, the driving force inputted from the motor M2 is not transmitted to the cam mechanism 131.

Next, the operation for separating the driven discharge roller 133 shown in Step ST8 will be explained. The solenoid control portion 54 switches the planetary gear mechanism 150A from the cutoff state to the transmission state and controls such that the driven discharge roller 133 separates from the driving discharge roller 132. Specifically, as shown in FIG. 12B, the solenoid control portion 56 turns the moving member 172 by energizing the solenoid 171 and engages the second locking claw 172*b* of the moving member 172 with the locked portion 153*a* of the inner tooth gear 153. At this time, because the rotation of the inner tooth gear 153 is restricted and the motor M2 rotates in the direction A, the sun gear 151 rotates in the direction A and the plurality of planet gears 152 revolves around the sun gear 151 in the direction A while rotating in the direction B. Thereby, the planet carrier 154A rotates in the direction A and the tooth portion 155 of the tooth lacking gear 154*d* meshes with the gear portion 139*b*, so that the cam shaft 138 rotates in the direction B by a predetermined angle. As a result, the cam shaft 138 moves from the first position to the second position. That is, the cam surface 137*a* of the cam 137 presses down the convex portion 134*b* and the support member 134 turns by resisting against the bias force of the bias spring 135, so that the driven discharge roller 133 swings in a direction of separating from the driving discharge roller 132.

Then, when the cam shaft 138 rotates by the predetermined angle in the direction B from the first position and is positioned at the second position, the convex portion 139*a* of the cam driving gear 139 butts against the opposed wall 120 and the rotation of the cam shaft 138 in the direction B is halted. It is noted that even though the planet carrier 154A tries to rotate in the direction A even if the rotation in the direction B of the cam shaft 138 is halted, no driving force of the motor M2 is transmitted to the cam mechanism 131 because the tooth lacking portion 156 of the tooth lacking gear 154*d* faces the gear portion 139*b* of the cam driving gear 139. This arrangement makes it possible to halt the cam shaft 138 accurately at the second position regardless of accuracy of an operation time of the solenoid 171 and to prevent the planet carrier 154A and others from being damaged by an excessive load otherwise applied to them.

Still further, when the rotation of the cam shaft 138 is restricted by the opposed wall 120, the sensor control portion 57 sends a signal to the ADF control portion 54. When the ADF control portion 54 receives the signal, the solenoid control portion 56 turns off the energization of the solenoid 171 and releases the lock state of the inner tooth gear 153 locked by the moving member 172. Then, as shown in FIG. 12C, the moving member 172 locks the planet carrier 154A by engaging the first locking claw 172*a* with the locked portion 154*c* by the bias force of the coil spring 175. Thereby, the inner tooth gear 153 rotates idly in the direction A and the planetary gear mechanism 150A is put into the cutoff state in which the transmission of the power from the motor M2 to the cam mechanism 131 is cut off. Thus, the control for separating the driven discharge roller 133 from the driving discharge roller 132 is completed.

Next, the operation for pressing the driven discharge roller 133 again described in Step ST14 in FIG. 10 will be explained. The solenoid control portion 56 switches the planetary gear mechanism 150A from the cutoff state to the transmission state and controls such that the driven discharge roller 133 presses the driving discharge roller 132 again. Specifically, as shown in FIG. 12D, the solenoid control portion 56 energizes the solenoid 171 to turn the moving member 172 and release the lock state of the planet carrier 154A locked by the first locking claw 172*a* and engages the second locking claw 172*b* of the moving member 172 with the locked portion 153*a* of the inner tooth gear 153. At this time, because the motor M2 rotates in the direction B in the state in which the rotation of the inner tooth gear 153 is restricted, the sun gear 151 rotates in the direction B and the plurality of planet gears 152 revolves in the direction B around the sun gear 151 while rotating in the direction A. Thereby, the planet carrier 154A rotates in the direction B and the tooth portion 155 of the tooth lacking gear 154*d* meshes with the gear portion 139*b*, so that the cam shaft 138 rotates in the direction A by a predetermined angle. As a result, the cam shaft 138 moves from the second position to the first position. That is, the cam surface 137*a* of the cam 137 separates from the convex portion 134*b* and the support member 134 turns in the bias direction of the bias spring 135, so that the driven discharge roller 133 presses the driving discharge roller 132 again.

Then, when the cam shaft 138 rotates in the direction A by the predetermined angle from the second position and is positioned at the first position, the convex portion 139*a* of the cam driving gear 139 butts against the opposed wall 120 and the rotation in the direction A of the cam mechanism 131 is halted. When the rotation of the cam shaft 138 is restricted by the opposed wall 120, the sensor control portion 57 transmits a signal to the ADF control portion 54. When the ADF control portion 54 receives the signal, the solenoid control portion 56 turns off the energization of the solenoid 171 and release the lock state of the inner tooth gear 153 locked by the moving member 172. Then, the moving member 172 locks the planet carrier 154A as shown in FIG. 12A by engaging the first locking claw 172*a* with the locked portion 154*b* by the bias force of the coil spring 175. Thereby, the planetary gear mechanism 150 is put into the cutoff state in which the transmission of the power from the motor M2 to the cam mechanism 131 is cut off. Thus, the control for separating the driven discharge roller 133 from the driving discharge roller 132 is completed.

As described above, according to the printer of the second embodiment, the torque limiter 160 and the output gear 161 become unnecessary, so that it is possible to contact/separate the driven discharge roller 133 with/from the driving discharge roller 132 with the simpler configuration whose cost is cut.

It is noted that although the abovementioned embodiments have been explained by exemplifying the electro-photographic printer, the present invention is not limited to that. For instance, the present invention is also applicable to an ink-jet type printer (image forming apparatus) forming an image by discharging ink droplets from a nozzle.

Still further, although the position where the convex portion 139*a* of the cam driving gear 139 butts against the opposed wall 120 has been defined as the first and second positions of the cam shaft 138 in the embodiments described above, it is also possible to configure such that the first and second positions of the cam shaft 138 are detected by a potentiometer and an encoder, instead of the convex portion 139*a* and the opposed wall 120.

Still further, although a single pinion type planetary gear has been exemplified as the planetary gear mechanisms 150 and 150A in the embodiments described above, it is also possible to use a double pinion type planetary gear. In such a case, while the rotation direction of the inner tooth gear 153 is opposite from that of the present embodiment, the rotation direction of the planet carrier 154 and 154A does not change.

Still further, while the planetary gear mechanisms 150 and 150A configured to input the driving force of the motor M2 from the sun gear 151 and to output from the planet carriers 154 and 154A have been exemplified in the embodiments described above, it is possible to arbitrarily set such that the power is inputted from or outputted from which component among the three components of the sun gear, the inner tooth gear and the planet carrier the power. For instance, the driving force of the motor M2 may be inputted from the planet carrier and may be outputted from the inner tooth gear.

Still further, while the driven discharge roller 133 is lifted by the cam mechanism 131 in the embodiments described above, it is also possible to configure such that the driven discharge roller 133 is lifted not only by the cam mechanism but also by a link for example.

Still further, while the motor M2, i.e., the driving source, is configured to rotate normally and reversely in the embodiments described above, it is also possible to configure the motor M2 so as to rotate only in one direction and to provide a switching mechanism switching the rotation based on the motor M2 to normal rotation or reverse rotation within a power transmission path for transmitting the rotation generated from the motor M2 to the planetary gear mechanism 150 or 150A. For instance, the switching mechanism may include a first gear train, a second gear train having one more gear than the first gear train, and a selection mechanism alternatively selecting these first and second gear trains.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-194824, filed on Sep. 20, 2013, and Japanese Patent Application No. 2014-186457, filed on Sep. 12, 2014, which are hereby incorporated by reference herein in their entirety.

What is claimed is:

1. A sheet feeding apparatus comprising:

a conveying roller pair configured to convey a sheet;

a discharge roller pair including a driving discharge roller configured to normally rotate and discharge the sheet out of the apparatus and to reversely rotate and convey again the sheet that has been once passed through the conveying roller pair toward the conveying roller pair, and a driven discharge roller configured to rotate by being driven by the driving discharge roller;

a driving source; and a separating mechanism configured to contact the driven discharge roller with the driving discharge roller and separate the driven discharge roller from the driving discharge roller by switching input rotations generated by the driving source to normal and reverse rotations, the separating mechanism including:

a support portion rotatably supporting the driven discharge roller;

a swing mechanism configured to swing the support portion by receiving a driving force from the driving source and separate the driven discharge roller from the driving discharge roller;

a planetary gear mechanism provided within a power transmission path from the driving source to the swing mechanism and including first and second rotary components; and a switching portion switching the planetary gear mechanism to a transmission state in which a power of the driving source is transmitted from the driving source to the swing mechanism and to a cutoff state in which the transmission of the power from the driving source to the swing mechanism is cut off, the switching portion including:

a moving member including a first locking portion locking the first rotary component and putting the planetary gear mechanism in the transmission state, and a second locking portion locking the second rotary component and putting the planetary gear mechanism into the cutoff state; and a solenoid switching the planetary gear mechanism to the transmission state and to the cutoff state by moving the moving member.

2. The sheet feeding apparatus according to claim 1, wherein the planetary gear mechanism includes, a sun gear connected to the driving source, a plurality of planet gears meshed with the sun gear, an inner tooth gear meshing with the plurality of planet gears, and a planet carrier rotatably supporting the plurality of planet gears and transmitting the driving force to the swing mechanism, and wherein the inner tooth gear is the first rotary component and the planet carrier is the second rotary component.

3. The sheet feeding apparatus according to claim 1, wherein the separating mechanism includes a restricting portion configured to restrict a rotation range of a rotary shaft of the swing mechanism to which the driving force from the planetary gear mechanism is transmitted between a first position in which the driven discharge roller is in pressure contact with the driving discharge roller and a second position in which the driven discharge roller is separated from the driving discharge roller.

4. The sheet feeding apparatus according to claim 3, wherein the switching portion releases a lock state of the first rotary component and locks the second rotary component when the rotary shaft of the swing mechanism moves from either one of the first and second positions to another one of the first and second positions and the rotation is restricted by the restricting portion in the state in which the switching portion locks the first rotary component.

5. The sheet feeding apparatus according to claim 3, wherein the separating mechanism includes a torque limiter interposed between the rotary shaft of the swing mechanism and the planetary gear mechanism and cutting off the transmission of the power from the planetary gear mechanism to the rotary shaft in a case where the rotation of the rotary shaft is restricted by the restricting portion and a driving torque to be transmitted from the planetary gear mechanism to the rotary shaft exceeds a predetermined value.

6. The sheet feeding apparatus according to claim 3, wherein the second rotary component includes a tooth lacking gear transmitting the power by meshing with a driven gear provided on the rotary shaft of the swing mechanism, and the tooth lacking gear includes a gear portion rotating the rotary shaft by a predetermined angle between the first and second positions by meshing with the driven gear and a tooth lacking portion continuously formed with the gear portion and cutting off the transmission of the power to the rotary shaft by unmeshing with the driven gear.

7. The sheet feeding apparatus according to claim 1, wherein the driving source normally and reversely rotates the driving discharge roller.

8. The sheet feeding apparatus according to claim 7, wherein the driving source rotates in the first direction to reversely rotate the driving discharge roller and generates such a driving force that makes the separating mechanism separate the driven discharge roller from the driving discharge roller, and wherein the driving source rotates in a second direction to normally rotate the driving discharge roller and generates such a driving force that makes the separating mechanism contact the driven discharge roller with the driving discharge roller.

9. The sheet feeding apparatus according to claim 1, wherein the switching portion includes a bias portion biasing such that the second locking portion locks the second rotary component.

10. The sheet feeding apparatus according to claim 1, further comprising a bias member biasing the support portion such that the driven discharge roller comes into pressure contact with the driving discharge roller.

11. An image reading apparatus comprising:

the sheet feeding apparatus as set forth in claim 1; and an image reading portion configured to read an image of a sheet fed by the sheet feeding apparatus.

12. An image forming apparatus comprising:

the image reading apparatus as set forth in claim 11; and an image forming portion configured to be able to form an image read by the image reading apparatus on a recording medium.

13. A sheet feeding apparatus comprising:

a conveying roller pair configured to convey a sheet;

a discharge roller pair including a driving discharge roller configured to normally rotate and discharge the sheet out of the apparatus and to reversely rotate and convey again the sheet that has been once passed through the conveying roller pair toward the conveying roller pair, and a driven discharge roller configured to rotate by being driven by the driving discharge roller;

a driving source; and a separating mechanism configured to contact the driven discharge roller with the driving discharge roller and separate the driven discharge roller from the driving discharge roller by switching input rotations generated by the driving source to normal and reverse rotations, the separating mechanism including:

a support portion rotatably supporting the driven discharge roller;

a swing mechanism configured to swing the support portion by receiving a driving force from the driving source and separate the driven discharge roller from the driving discharge roller;

a planetary gear mechanism provided within a power transmission path from the driving source to the swing mechanism and including first and second rotary components; and a switching portion switching the planetary gear mechanism to a transmission state in which a power of the driving source is transmitted from the driving source to the swing mechanism and to a cutoff state in which the transmission of the power from the driving source to the swing mechanism is cut off, the switching portion including:

a first locking portion locking the first rotary component and putting the planetary gear mechanism in the transmission state; and a second locking portion locking the second rotary component and putting the planetary gear mechanism into the cutoff state;

a restricting portion configured to restrict a rotation range of a rotary shaft of the swing mechanism to which the driving force from the planetary gear mechanism is transmitted between a first position in which the driven discharge roller is in pressure contact with the driving discharge roller and a second position in which the driven discharge roller is separated from the driving discharge roller; and a torque limiter interposed between the rotary shaft of the swing mechanism and the planetary gear mechanism and cutting off the transmission of the power from the planetary gear mechanism to the rotary shaft in a case where the rotation of the rotary shaft is restricted by the restricting portion and a driving torque to be transmitted from the planetary gear mechanism to the rotary shaft exceeds a predetermined value.

14. An image reading apparatus comprising:

the sheet feeding apparatus as set forth in claim 13; and an image reading portion configured to read an image of a sheet fed by the sheet feeding apparatus.

15. An image forming apparatus comprising:

the image reading apparatus as set forth in claim 14; and an image forming portion configured to be able to form an image read by the image reading apparatus on a recording medium.

16. A sheet feeding apparatus comprising:

a conveying roller pair configured to convey a sheet;

a discharge roller pair including a driving discharge roller configured to normally rotate and discharge the sheet out of the apparatus and to reversely rotate and convey again the sheet that has been once passed through the conveying roller pair toward the conveying roller pair, and a driven discharge roller configured to rotate by being driven by the driving discharge roller;

a driving source; and a separating mechanism configured to contact the driven discharge roller with the driving discharge roller and separate the driven discharge roller form the driving discharge roller by switching input rotations generated by the driving source to normal and reverse rotations, the separating mechanism including:

a support portion rotatably supporting the driven discharge roller;

a swing mechanism configured to swing the support portion by receiving a driving force from the driving source and separate the driven discharge roller from the driving discharge roller;

a planetary gear mechanism provided within a power transmission path from the driving source to the swing mechanism and including first and second rotary components; and a switching portion switching the planetary gear mechanism to a transmission state in which a power of the driving source is transmitted from the driving source to the swing mechanism and to a cutoff state in which the transmission of the power from the driving source to the swing mechanism is cut off, the switching portion including:

a first locking portion locking the first rotary component and putting the planetary gear mechanism in the transmission state; and a second locking portion locking the second rotary component and putting the planetary gear mechanism into the cutoff state;

a restricting portion configured to restrict a rotation range of a rotary shaft of the swing mechanism to which the driving force from the planetary gear mechanism is transmitted between a first position in which the driven discharge roller is in pressure contact with the driving discharge roller and a second position in which the driven discharge roller is separated from the driving discharge roller, wherein the second rotary component includes a tooth lacking gear transmitting the power by meshing with a driven gear provided on the rotary shaft of the swing mechanism, and the tooth lacking gear includes a gear portion rotating the rotary shaft by a predetermined angle between the first and second positions by meshing with the driven gear and a tooth lacking portion continuously formed with the gear portion and cutting off the transmission for the power to the rotary shaft by unmeshing with the driven gear.

17. An image reading apparatus comprising:

the sheet feeding apparatus as set forth in claim 16; and an image reading portion configured to read an image of a sheet fed by the sheet feeding apparatus.

18. An image forming apparatus comprising:

the image reading apparatus as set forth in claim 17; and an image forming portion configured to be able to form an image read by the image reading apparatus on a recording medium.

* * * * *